US006962235B2

(12) United States Patent
Leon

(10) Patent No.: US 6,962,235 B2
(45) Date of Patent: Nov. 8, 2005

(54) APPARATUS FOR EXTERIOR EVACUATION FROM BUILDINGS

(75) Inventor: Robert L. Leon, Maple Glen, PA (US)

(73) Assignee: Life-Pack Technologies, Inc., Maple Glen, PA (US)

( * ) Notice: Subject to any disclaimer, the term of this patent is extended or adjusted under 35 U.S.C. 154(b) by 0 days.

(21) Appl. No.: 10/757,956

(22) Filed: Jan. 15, 2004

(65) Prior Publication Data

US 2004/0168855 A1 Sep. 2, 2004

Related U.S. Application Data

(60) Provisional application No. 60/449,125, filed on Feb. 21, 2003, provisional application No. 60/468,845, filed on May 8, 2003, and provisional application No. 60/492,398, filed on Aug. 4, 2003.

(51) Int. Cl.[7] ..... A62B 1/06; A62B 1/08; B65H 59/16

(52) U.S. Cl. ..... 182/73; 182/236; 188/65.1

(58) Field of Search ..... 182/73, 254, 193, 182/192, 231, 191, 236, 71, 239, 3, 240; 188/188, 65.1, 65.2, 65.4, 65.5

(56) References Cited

U.S. PATENT DOCUMENTS

| | | | | | |
|---|---|---|---|---|---|
| 1,296,052 | A | * | 3/1919 | Dietz | 182/239 |
| 2,680,593 | A | * | 6/1954 | McIntyre | 182/231 |
| 3,556,261 | A | * | 1/1971 | Pugh | 182/240 |
| 3,861,496 | A | | 1/1975 | Hoover | |
| 3,889,777 | A | * | 6/1975 | George | 182/6 |
| 3,946,989 | A | * | 3/1976 | Tsuda | 182/241 |
| 4,171,795 | A | * | 10/1979 | Bianchi | 182/236 |
| 4,198,033 | A | | 4/1980 | de la Messuziere | |
| 4,432,437 | A | * | 2/1984 | McClung | 182/234 |
| 4,457,400 | A | * | 7/1984 | Donaldson et al. | 182/234 |
| 4,469,196 | A | | 9/1984 | Sadler | |
| 4,487,292 | A | | 12/1984 | Smith et al. | |
| 4,567,963 | A | * | 2/1986 | Sugimoto | 182/236 |
| 4,623,038 | A | * | 11/1986 | Stancato | 182/239 |
| 4,640,388 | A | * | 2/1987 | Walborn | 182/231 |
| 4,722,422 | A | * | 2/1988 | Hiraoka | 182/233 |
| 5,060,758 | A | * | 10/1991 | Ishioka | 182/234 |
| 5,186,165 | A | | 2/1993 | Swann | |
| 5,211,613 | A | | 5/1993 | Friesl | |
| 5,581,901 | A | * | 12/1996 | Takahashi | 182/231 |
| 5,711,404 | A | | 1/1998 | Lee | |
| 5,842,542 | A | * | 12/1998 | Tien | 182/231 |
| 6,371,244 | B2 | * | 4/2002 | Okamura | 182/72 |
| 6,550,576 | B1 | * | 4/2003 | Meller | 182/73 |
| 6,672,428 | B2 | * | 1/2004 | Gelman | 182/233 |
| 6,808,047 | B2 | * | 10/2004 | Takeshima | 182/70 |
| 6,817,443 | B1 | * | 11/2004 | Metz | 182/82 |
| 2002/0179372 | A1 | | 12/2002 | Schreiber et al. | |
| 2003/0070872 | A1 | | 4/2003 | Meller | |

* cited by examiner

*Primary Examiner*—Hugh B. Thompson, II
(74) *Attorney, Agent, or Firm*—Akin Gump Strauss Hauer & Feld, LLP

(57) ABSTRACT

An apparatus for safely evacuating a person within a prescribed weight range from a multistory building by enabling the person to exit from the interior of the building to the outside very quickly and to descend to the ground or lower surface alongside the exterior of the building to attain a descent speed of less than four feet per second to land injury-free, the apparatus comprising a housing, a harness affixed to the housing for affixing the housing to the person, a cable of predetermined length within the housing, having a free-end with a securing member for affixing it to an anchorage proximate the descent point, and a descent slowing energy dissipating mechanism within the housing driven by the playout of the cable as the person descends, which enables the person to attain automatically within his descent a descent speed of less than four feet per second determined by the intersection of the graph of the curve that describes the rate of energy dissipated as a function of the descent speed and the graph of the line that describes the rate of potential energy released by the total descending weight as a function of descent speed where the slove of the graph of the rate of energy dissipated curve exceeds the slone of the graph of the rate of potential energy released line.

43 Claims, 12 Drawing Sheets

APPARATUS FOR EXTERIOR EVACUATION FROM BUILDINGS

CROSS REFERENCE TO RELATED APPLICATIONS

This application claims priority from Provisional Application Ser. No. 60/449,125 filed Feb. 21, 2003, Provisional Application No. 60/468,845 filed May 8, 2003, and Provisional Application Ser. No. 60/492,398 filed Aug. 4, 2003.

BACKGROUND OF THE INVENTION

The World Trade Center disaster in New York City on Sep. 11, 2001 has highlighted the need for an apparatus to provide for the rapid and safe evacuation of large numbers of persons along the exterior of a high-rise building during a major fire or other life-threatening emergency when the stairwells are inaccessible, unusable, overcrowded, smoke-filled, obstructed, or otherwise unsafe.

Major fires in high rise office buildings and hotels often trap people on the floors above, stranding them to succumb to smoke inhalation, carbon monoxide, and fire, or to leap to their deaths (as nearly 200 did during the WTC disaster). Thus there exists the need for an apparatus capable of getting large numbers of people very quickly out of the deadly interior of a burning building into the fresh air on the smoke-free side of the building, then lowering them to the ground (or other safe surface below the fire), very slowly so they can maneuver safely past hazards presented by the facade of the building and each other, and land on the ground (or the other safe surface) injury-free, regardless of the building's height or shape. Even with the fastest possible escape to the outside, some of the people will have to brave the deadly gases inside for at least a while, so the apparatus should also include a means for providing them breathable air during that time.

The host of devices available or proposed for escaping from high-rise buildings include low-altitude parachutes, tubular net life-chutes, aerial vertical takeoff and landing (VTOL) rescue platforms, and controlled descent devices. The low altitude parachutes cannot be used below the 15th floor, and they can collapse if the novice parachutist drifts into the side of his or an adjacent building, something even an experienced parachutist is likely to do. Tubular net life chutes are limited, both in their numbers and locations in a building, thereby significantly limiting the number of people they can save. And they can blow uncontrollably in high winds, making them impractical to use on very tall buildings. VTOL rescue platforms are only in the proposal stage, with the largest claiming to hold only up to ten people. Controlled-descent devices may be user-controlled, or automatic. With the user-controlled type, the person controls his speed by continually adjusting the friction applied to a rope that's suspended from the departure point down to the ground. However, it requires training and skill and isn't practical from great heights. Although the automatic type can be used by untrained persons, it is heavier and more expensive. Thus it is typically employed up at the departure point to mete out the rope or cable—usually too fast for a safe descent alongside the facade of a building, and yet too slow to evacuate hundreds of people, since each controller lets down just "one-person-at-a-time."

To achieve the slowest descent speed and the fastest mass evacuation rate, each person needs his own wearable, lightweight, low-speed, automatic controller and cable.

BRIEF SUMMARY OF THE INVENTION

Briefly stated, the present invention comprises an apparatus for enabling a person within a prescribed weight range to descend from an origin at a predetermined height in a multistory building to a lower supporting surface and to attain a descent speed of less than four feet per second to land injury-free, the apparatus comprising a housing; a harness affixed to the housing for securely affixing the housing to the person; a cable within the housing of predetermined length sufficient to reach from the origin to the lower supporting surface, the cable having a free end which includes a securing member for attaching the free end to a fixed anchorage proximate the origin; and a descent-slowing energy dissipating mechanism within the housing, driven by the play-out of the cable as the person descends, which enables the person to attain automatically within his descent a descent speed of less than four feet per second without the person's control determined by the intersection of the graph of the curve that describes the rate of energy dissipated as a function of the descent speed and the graph of the line that describes the rate of potential energy released by the total descending weight as a function of the descent speed where the slope of the graph of the rate of energy dissipated curve exceeds the slope of the graph of potential energy released line.

The preferred embodiment is a self-contained apparatus that can be quickly put on over existing clothing. It has a helmet assembly that contains an air filtration system to provide breathable air to the person at least while he waits to egress the building. It then lowers him to the ground automatically on his own spool of high strength cable alongside the exterior of the building at an average speed of about one foot per second (1 ft/see). Even at that extremely slow speed, it takes a mere twenty-four minutes to reach the ground from the highest occupied floor of either the Sears Tower in Chicago at 1,431 feet, or "Taipei 101" in Taiwan at 1,441 feet—the newest title holder for the world's highest occupied floor. After simple anchorages are installed on every floor, the present invention is well suited for the rapid and safe evacuation of thousands of persons from such tall buildings. In short, the present invention is an apparatus, for 1) providing a means for every person on every floor to quickly exit the deadly interior of a building regardless of the person's size or physical skills, while 2) still protecting them against smoke and other deadly gases while they wait to exit, then 3) providing them a slow, automatic descent to the ground alongside the exterior of the building regardless of the building's configuration or height, while 4) continuing to provide them protection against smoke, heat, and falling debris. The present apparatus (one per person) enables every trapped person to escape from the interior of the building in minutes, and be gently deposited on the ground totally unscathed less than a half-hour later even from the tallest building. Unlike enclosed chutes, there is no maximum height. And unlike parachutes, no minimum height. And unlike devices that require user control, there is complete safety without any prior training. Also, the same size apparatus is utilized for persons of all sizes and weights ranging from 60 pounds to 360 pounds.

In the preferred embodiment to be described herein, the energy dissipating mechanism is a small, self-contained, semi-cylindrically vaned, high-speed fan that can automatically control the unreeling of the cable at the very safe, average descent speed of approximately one foot per second (1 ft/sec) for the population of persons spanning 60 to 360 pounds in a "one-size fits-all" apparatus. Other alternative energy dissipating mechanisms, which also satisfy the inventive principles of the present invention, may be used in alternate embodiments.

BRIEF DESCRIPTION OF THE DRAWINGS

The foregoing summary, as well as the following detailed description of the physical principles, the comparison to the prior art, and the preferred embodiment of the present invention will all be better understood when read in conjunction with the appended drawings. For the purpose of illustrating the invention, particular arrangements and methodologies are shown in the drawings. It should be understood, however, that the invention is not limited to the precise arrangements shown, or the methodologies of the detailed description. In the drawings:

FIG. 8*a*1 is the front view and FIG. 8*a*2 is the side view of the clear plastic helmet; FIG. 8*e*1 is the front cross-sectional view and FIG. 8*e*2 is the side cross-sectional view of the canister holder.

FIGS. 10*a*1 and 10*a*2 show the girder clamp; FIGS. 10*b*1 and 10*b*2 show the anchor box.

DETAILED DESCRIPTION OF THE INVENTION

Understanding the Physics

Figure 1:
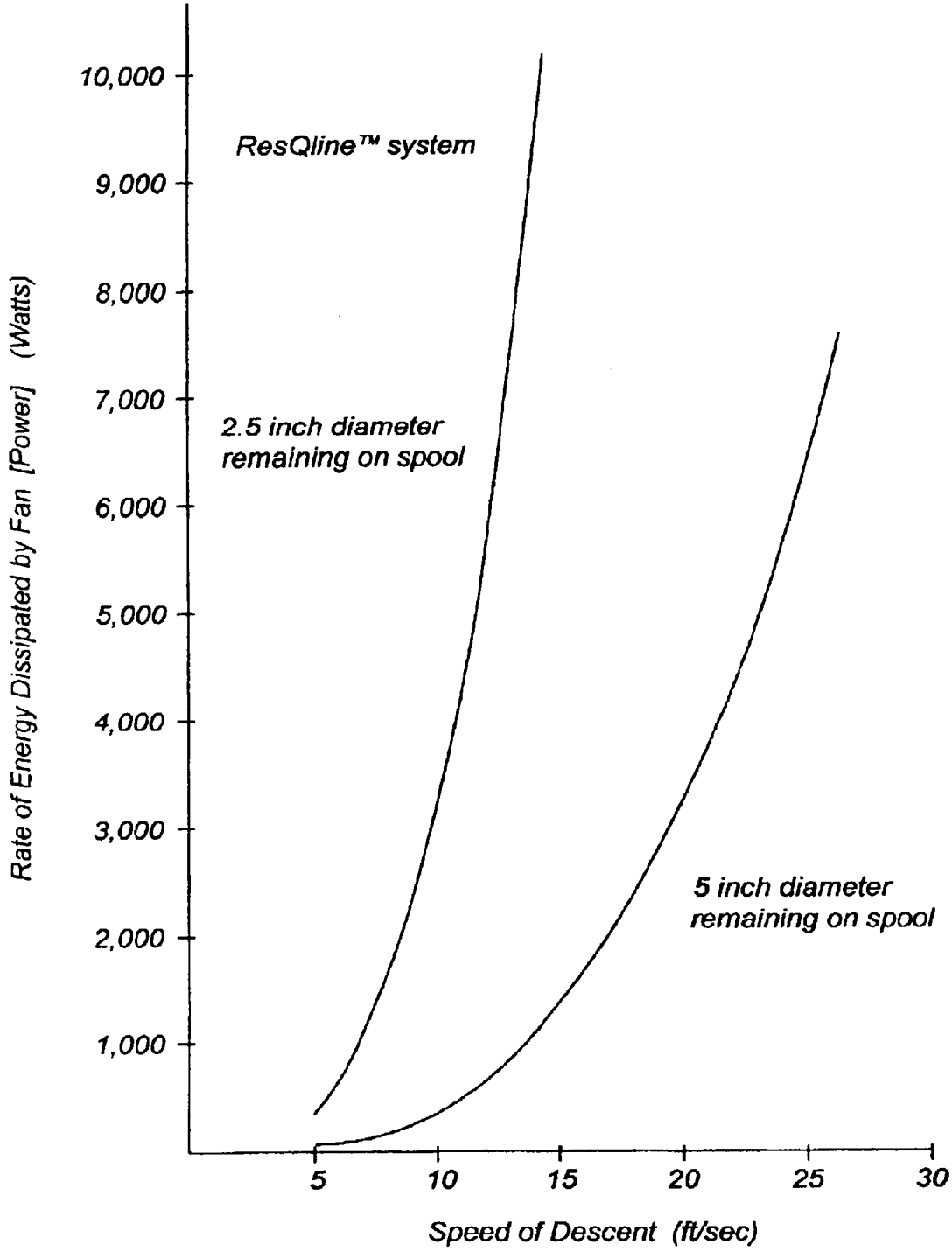
FIG. 1 is a graph showing the relationship between the rates of energy dissipated by a prior art device vs. the speed of descent.

Picture a 200 pound man about to jump from the window of a burning building from a height of 1,000 feet. He has zero kinetic energy. However, he has 200,000 ft-lbs of potential energy. If he jumps—neglecting the small portion of that energy that gets converted to heat energy by the air resistance as his speed increases—all that potential energy gets converted to 200,000 ft-lbs of kinetic energy which will increase his speed to 252 ft/sec (172 MPH) by the time the unfortunate fellow hits the ground 8 seconds later. What can save him is a mechanism for dissipating all the released potential energy that otherwise goes toward increasing his descent velocity. That descent-slowing, energy-dissipating mechanism would convert the released potential energy into increased random kinetic energy of the individual air molecules that surround the mechanism, with a portion temporarily going into increased random kinetic energy of the individual molecules of the mechanism itself, thereby increasing its temperature. That increase in temperature may be quite large in the case of limited airflow, or limited in the case of high-volume airflow.

In determining the parameters of such a descent-slowing, energy-dissipating mechanism, it is useful to look at the problem in terms of watts. Using the conversion: one foot lb equals 1.355 watt seconds, the initial potential energy for the above 200 lb man is equal to 271,000 watt seconds. That figure is equal to the average power that must be dissipated by the mechanism, multiplied by the time to reach the ground.

The speed of descent in feet per second is determined by the intersection of the curve describing the rate of energy dissipated by the descent-slowing energy-dissipating mechanism in watt seconds per second (or watts) versus the speed of descent in feet per second with the line describing (for the given weight) the rate of potential energy released in watt seconds per second (or watts) versus the speed of descent in feet per second, where the slope of the former exceeds the slope of the latter to assure a stable situation.

Analyzing the (Prior Art) ResQline™ System

First to be analyzed is not the present invention, but a device called the Safir-Rosetti ResQline, invented by M. Meller (US-2003/0070872A1 & US-2003/007873A 1). It will be useful to compare it to the present invention. It consists basically of a spool of steel cable long enough to reach the ground (one spool per person), and an energy dissipating fan permanently and securely mounted to the floor beneath the window from which several persons are to egress the building. The fan is enclosed in a frame with a protective screen. The frame supports a platform, which in use extends out the window. The person climbs out onto the platform prior to pushing off. But before he climbs onto the platform he affixes his spool to a shaft extension of the fan and attaches the free end of the cable to his harness. As he descends, the cable will play out and rotate the spool, driving the fan. Its four equally spaced flat vanes are oriented perpendicular to the rotational motion to resist that rotation and thus limit the descent speed. When the fan finally stops rotating, the next person removes the previous person's spool (with the end of the cable still attached), and stores it away safely before affixing his own spool and attaching his-own cable to his harness and repeating the process.

$$P = 1.355\ A\left(\frac{C_D}{2}\right)\left(\frac{\rho_W}{g}\right)\left[(RPM)\left(\frac{\pi}{30}\right)(R_{EFF})\right]^3 \quad (1)$$

Where:

P=the rate of energy [or power] dissipated (in watts) by a single vane 1.355=the factor that converts ft-lbs/sec to watts A=the frontal or projected area of the vane in square feet $C_D$=the drag coefficient for the shape of the vane $\rho_W$=the weight density of air at the given temperature and pressure g=the acceleration of gravity constant, equal to 32.2 ft/sec$^2$ RPM=the speed of the fan in revolutions per minute $R_{EFF}$=the effective radius of the vane in feet $C_D$ equals 1.2 for a flat plate vane. Each of the four equally spaced vanes is approximately 15 inches long and 7.5 inches wide, and is mounted on a 1 inch shaft. Therefore, A equals 112.5 in$^2$ which converts to 0.781 ft$^2$, and $R_{EFF}$ equals 10.0 in. which converts to 0.833 ft.

The weight density of air is determined from the following equation:

$$\rho_W = 1.325\left(\frac{P_b}{T}\right) \tag{2}$$

Where:

$\rho_W$=the weight density of air in lbs/ft$^3$ 1.325=the factor that converts in-Hg/°R to lbs/ft$^3$ for air $P_b$=the barometric pressure in inches of mercury (assumed here to be 29.92)

T=is the air temperature in degrees Rankine, assumed to be 509.7°R (50° F.)

(Plugging in the above values, $\rho_W$=0.078 lbs per cubic foot)

To establish the curves for the rate of energy dissipated vs. descent rate, one must enter all the above values into equation (1) along with the relationship between descent speed and fan RPM at the beginning of the spool and at the end.

That relationship is defined by the spooled diameter of the cable. The initial spooled diameter of cable is approximately 5 inches, and the fully played-out spooled diameter is approximately 2.5 inches. That results in the following tabulated relationship between the descent speed in ft/sec and the fan RPM at the 5 inch and 2.5 inch diameters:

| | Fan RPM | |
|---|---|---|
| Descent Speed (ft/sec) | at 5 inch diameter | at 2.5 inch diameter |
| 5 | 229 | 458 |
| 10 | 458 | 916 |
| 15 | 687 | 1,374 |
| 20 | 916 | — |
| 25 | 1,145 | — |

These RPM values are plugged into equation (1) along with the other parameters to determine the curve of the rate of energy dissipated per vane (in watts) vs. the descent speed in (ft/sec), at the beginning and ending diameters. FIG. 1 shows the plot of 4P, the rate of energy dissipated by all four vanes (in watts) vs. the descent speed in (ft/sec), both at the beginning (5 inch diameter) and at the end (2.5 inch diameter).

The next step is to determine the line describing the rate of potential energy released (in watts) vs. the descent speed. Unlike the previous calculation, this depends upon the weight of the person descending. With every foot of descent, one foot pound of potential energy is released for each pound of weight. And so the rate of potential energy released is 1.355 watts every one ft/sec for every pound of weight. Therefore a 100 pound person descending at 10 ft/sec releases potential energy at the rate of 1,355 watts . . . at 20 ft/sec, 2,710 watts. A 200 pound person descending at 10 ft/sec releases potential energy at the rate of 2,710 watts . . . at 20 ft/sec, 5,420 watts. And a 300 pound person descending at 10 ft/sec releases potential energy at the rate of 4,065 watts . . . at 20 ft/sec, 8,130 watts.

Figure 2:
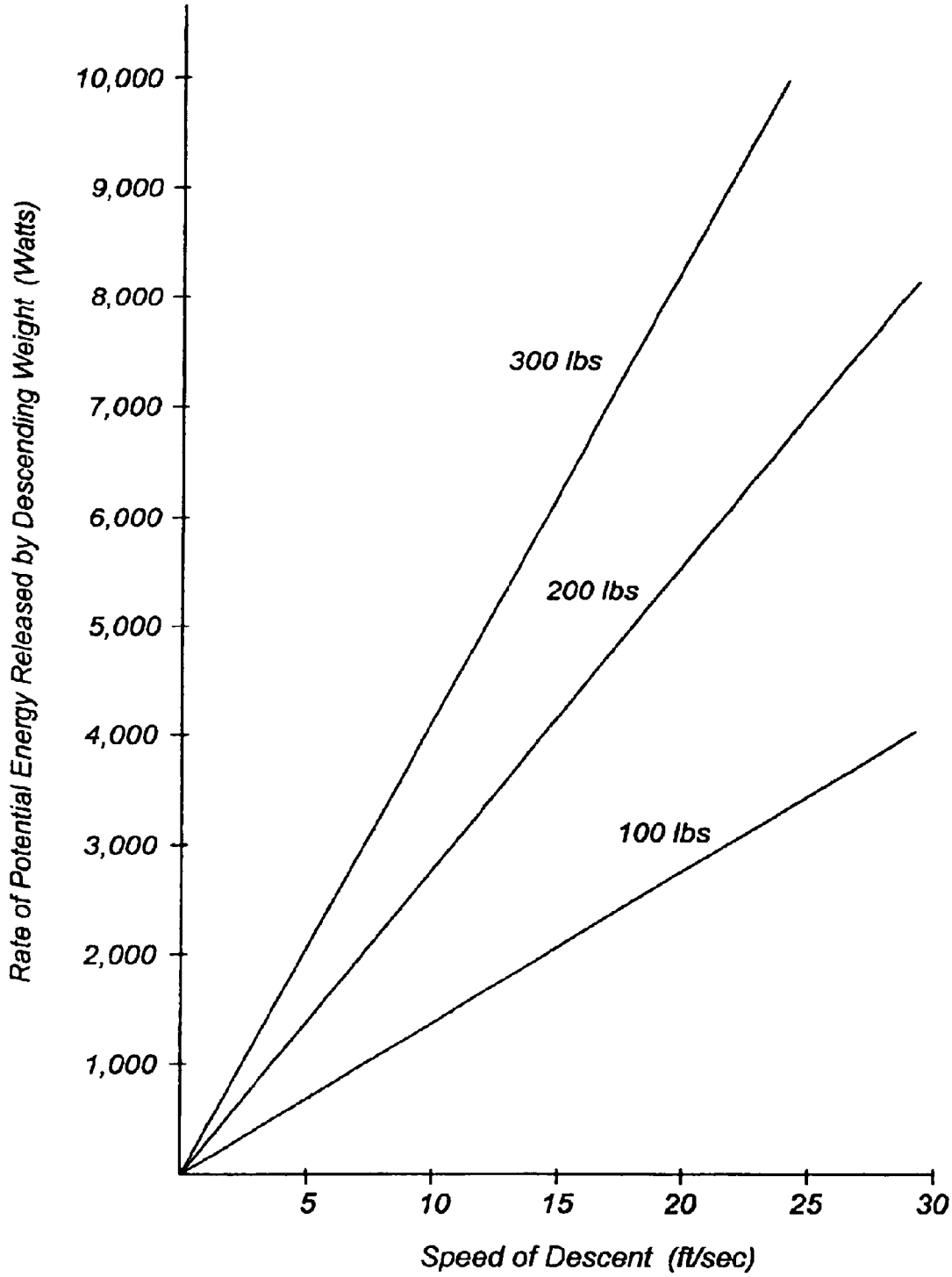
FIG. 2 is a graph showing the relationship between the rates of potential energy released by different descending weights vs. the speed of descent.
Figure 3:
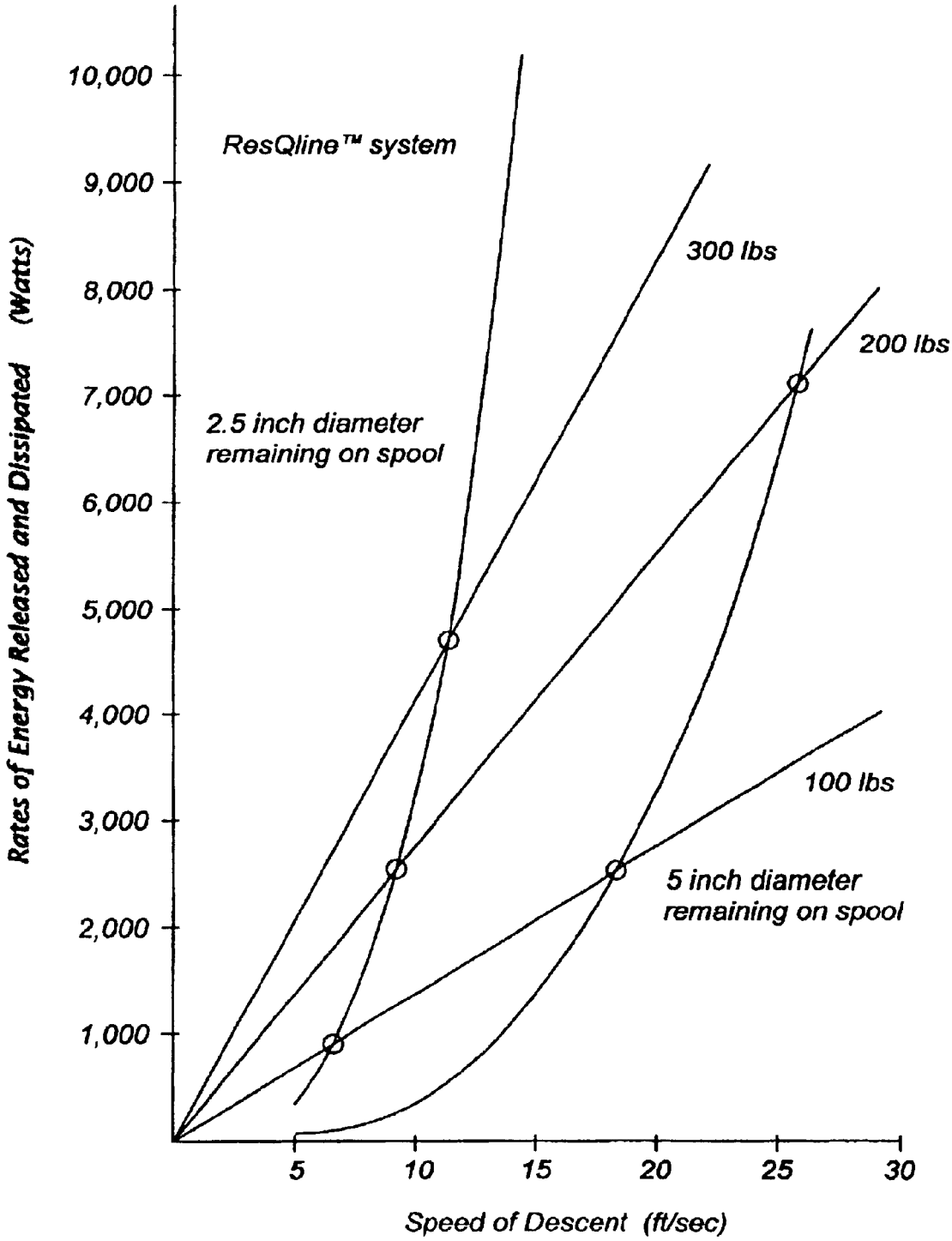
FIG. 3 is a graph showing the relationship between the rates of energy released and the rates of energy dissipated vs. the speed of descent, for a prior art device.

FIG. 2 shows the lines that describe the rate of potential energy released (in watts) vs. descent speed (in ft/sec) for 100, 200, and 300 pound persons. FIG. 3 shows the same three lines superimposed on FIG. 1, the curves that described the rate of energy dissipated (in watts) at the beginning and at the end of the spool. As indicated previously, the intersections of the lines with the curves determine the actual descent speeds.

The 100 pound person is seen to start out at 18.5 ft/sec at the initial 5 inch spool diameter, and end up as slow as 6.5 ft/sec as the spool runs down to the 2.5 inch diameter. The 200 pound person starts out at 26 ft/sec and ends up as slow as 9 ft/sec. And the 300 pound person starts out at 29 ft/sec and ends up as slow as 11 ft/sec. These values are in line with ResQline's published demonstration results, which seem to employ relatively slight subjects descending from only moderately tall buildings that probably require only a 5 inch spooled diameter at the start and 3 inches upon landing. During the descent in the ResQline system, all the cable that is not still on the spool is descending along with the subject, and that adds to the weight of the subject. This slightly increases the speed at the end, especially for lighter subjects. Taking all these beginning and ending speeds into account, this correlates with ResQline's use of a 15 ft/sec "average" descent velocity in all their evacuation calculations.

The maximum descent speed of 29 ft/sec (for a 300 pound person) is more than two stories per second. Even the descent speed of 15 ft/sec (the average for all persons for the complete descent) is typically more than one story per second. These high speeds can result in serious injury, as will be discussed in subsequent paragraphs.

Those descent speeds could have been reduced by increasing the size of the fan. For example, increasing the vane length from 15 inches to 18 inches would reduce the maximum descent speed for the 300 lb person from 29 ft/sec to 23.5 ft/sec. However, this positive reduction in descent speed is not substantial enough, and would be offset by the negative result that fewer persons will be evacuated, as each person must wait for the previous one to land and the fan to come to a full stop before he (or she) can remove the previous spool, store it, and replace it with his own to begin his own evacuation process.

Analyzing the Present Invention

The preferred embodiment of the present invention achieves a less than 2 ft/sec descent speed for all persons, utilizing an energy dissipating mechanism that is so small that both it and the spool of cable can be "worn" by the descending person. That allows each person to have his own cable and his own "extremely slow" descent mechanism, so that every person on every floor can exit the deadly interior of the building quickly (without having to wait for the previous person to fully descend), and then descend slowly and safely to the ground (along with all the others) alongside the exterior of even the tallest skyscraper, regardless of its external configuration.

After having analyzed the ResQline system, for which the average descent speed for all persons is a whopping 15 ft/sec, and where the energy dissipating fan is way too large to be worn, the claims of the present invention may appear far-fetched.

Yet, referring back to the section on understanding the physics, it was seen that dissipating a potential energy of 271,000 watt-seconds is required to bring a 200 lb man down safely from a height of 1,000 feet. That is an average 27,100 watts for 10 seconds, or 2,710 watts for 100 seconds, or 271 watts for 1,000 seconds. Notice that the longest times (i.e., the slowest descent speeds) require the smallest power dissipation. Thus, low power dissipation and low descent speed are not mutually exclusive. Indeed, the opposite is true. As a matter of fact, the previously suggested modification to increase the vane length of the ResQline fan from 15 inches to 18 inches would not only have resulted in a 19% decrease in the descent speed but a 19% decrease in the power dissipated by the fan. (Looking at FIG. 3, because the slope of the rate of the energy dissipated curve exceeds the slope of the rate of energy released line, the point of intersection—which defines the speed of descent and the power (the rate of energy) dissipated—moves downward, not upward, as the value of "P" in equation (1) is increased.)

But that was accomplished by increasing the fan size. How does the present invention bring about a corresponding decrease in size? The key is to make the energy dissipating mechanism rotate faster than the spool of unraveling cable. This rotational speed increase for the energy dissipating mechanism can be achieved using gears, belts, chains, wheels, or pulleys. However, gears are the preferred choice because belts and chains might break, and wheels and pulleys might slip. By utilizing the speed increase approach, several types of energy dissipating mechanisms can be made small enough to be worn by the person. In addition to having small size, the resulting power dissipation per pound of descending weight should be less than 5.4 watts/lb as a practical objective. That way, with a large airflow, it won't get hotter than a lavatory hand dryer (even with a 400 lb descending weight), and people won't be descending faster than 4 ft/sec, which in many instances is slow enough to avoid injuries. However, it will be shown that the preferred and other embodiments about to be discussed are able to achieve even lower (much cooler) power dissipation levels, and slower (much safer) stable descent speeds.

The preferred embodiment makes use of a small fan to dissipate the energy. Three geared shafts are employed, although the desired speed increase could be achieved with just two. The intermediate gear shaft provides the required separation distance, as well as more reasonable ratios, gear mesh to gear mesh. All three shafts are affixed to a common support frame. The drive shaft at the top contains the spool of cable and a very large gear. That large gear meshes with a smaller gear on the intermediate shaft, which contains in addition, a somewhat-larger gear. And that gear drives a much smaller gear on the fan shaft.

In this design, the large gear on the spool shaft is a ¾ inch wide, 12 pitch spur gear, with a 12 inch pitch diameter and 144 teeth. It meshes with a ¾ inch wide, 12 pitch spur gear with a 3 inch pitch diameter and 36 teeth on the intermediate shaft. Also on the intermediate shaft is a ½ inch wide, 20 pitch spur gear with a 5 inch pitch diameter and 100 teeth. And that meshes with the small gear on the fan shaft, which is a ½ inch wide, 20 pitch spur gear with a 1 inch pitch diameter and 20 teeth. For each rotation of the spool shaft, the intermediate shaft rotates four times and the fan shaft rotates twenty times.

Also the fan now has eight vanes instead of four. The vanes are no longer flat (with a $C_D$ of 1.2), but are semi-cylindrical with their open side forward. This has the affect of increasing the drag coefficient $C_D$ to 2.3. Also, doubling the number of vanes to eight is made possible by their semi-cylindrical shape, which lessens the drafting problem that would typically preclude increasing the number of flat vanes. Each semi-cylindrical vane has a frontal projected area of 2.5 inches by 8 inches, so A is 20 $in_2$, or 0.1389 $ft^2$ as required equation (1). And $R_{EFF}$, the effective radius to the center of the vanes, is now 4.9 inches, or 0.408 ft in equation (1).

Subsequent figures will illustrate the details of the gearing and the fan, and show how it's enclosed along with other key items in a "backpack" arrangement to be worn by the person who is about to escape from the building. But for now, this basic information is sufficient to perform another analysis using equation (1) to determine the descent speeds for a 100 lb, a 200 lb, a 300 lb, and in addition a 400 lb descending weight.

The maximum cable spool diameter at the beginning is now 6 inches, and the played-out spool diameter is 3.25 inches. The total length of cable is sufficient to extend from the highest occupied floor of the Sears Tower all the way to the ground. Because of the gearing, the fan rotates twenty times for every spool rotation—thereby making the descent speed one-twentieth of what it would be for the same fan speed as the ResQline system (at like spooled diameters). The following table gives the relationship between the new descent speeds (in ft/see) and the fan RPMs for a spooled diameter of 6 inches remaining on the cable spool, and for a spooled diameter of 3.25 inches remaining:

| | Fan RPM | |
|---|---|---|
| Descent Speed (ft/sec) | at 6 inch diameter | at 3.25 inch diameter |
| 0.5 | 382 | 705 |
| 1.0 | 764 | 1,410 |
| 1.5 | 1,146 | 2,115 |
| 2.0 | 1,528 | — |
| 2.5 | 1,910 | — |

Figure 4:
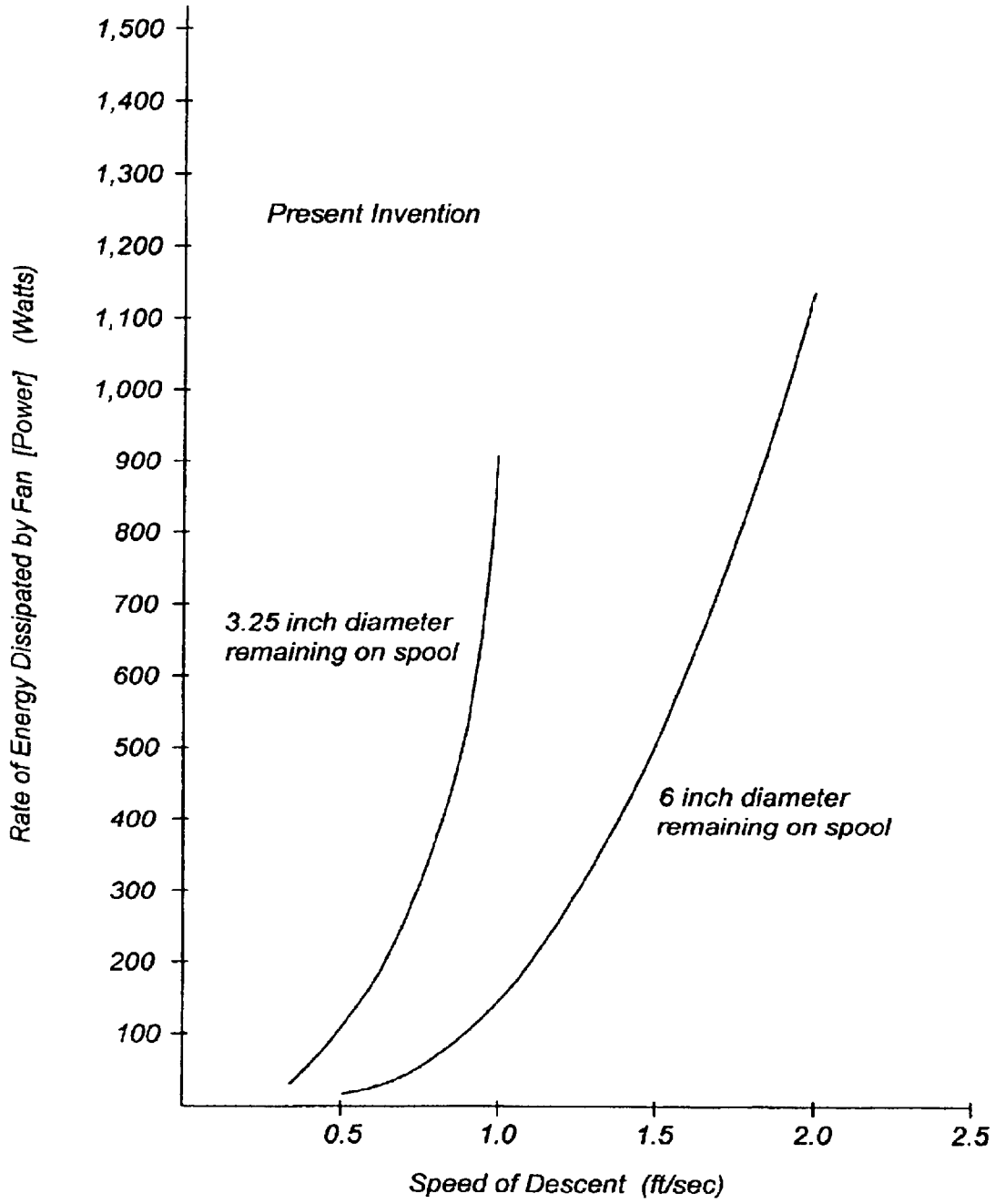
FIG. 4 is a graph showing the relationship between the rates of energy dissipated by the preferred embodiment of the present invention vs. the speed of descent.

FIG. 4 shows the curves for 8P (the rate of energy dissipated by all eight vanes) at the beginning where the spool of cable is 6 inches in diameter, and near the end where the spool of cable is 3.25 inches in diameter. These are arrived at by plugging in the new RPM values into equation (1), along with the revised values for A, $C_D$, and R effective, and plotting the results (multiplied by 8) at the new corresponding descent speeds.

Figure 5:
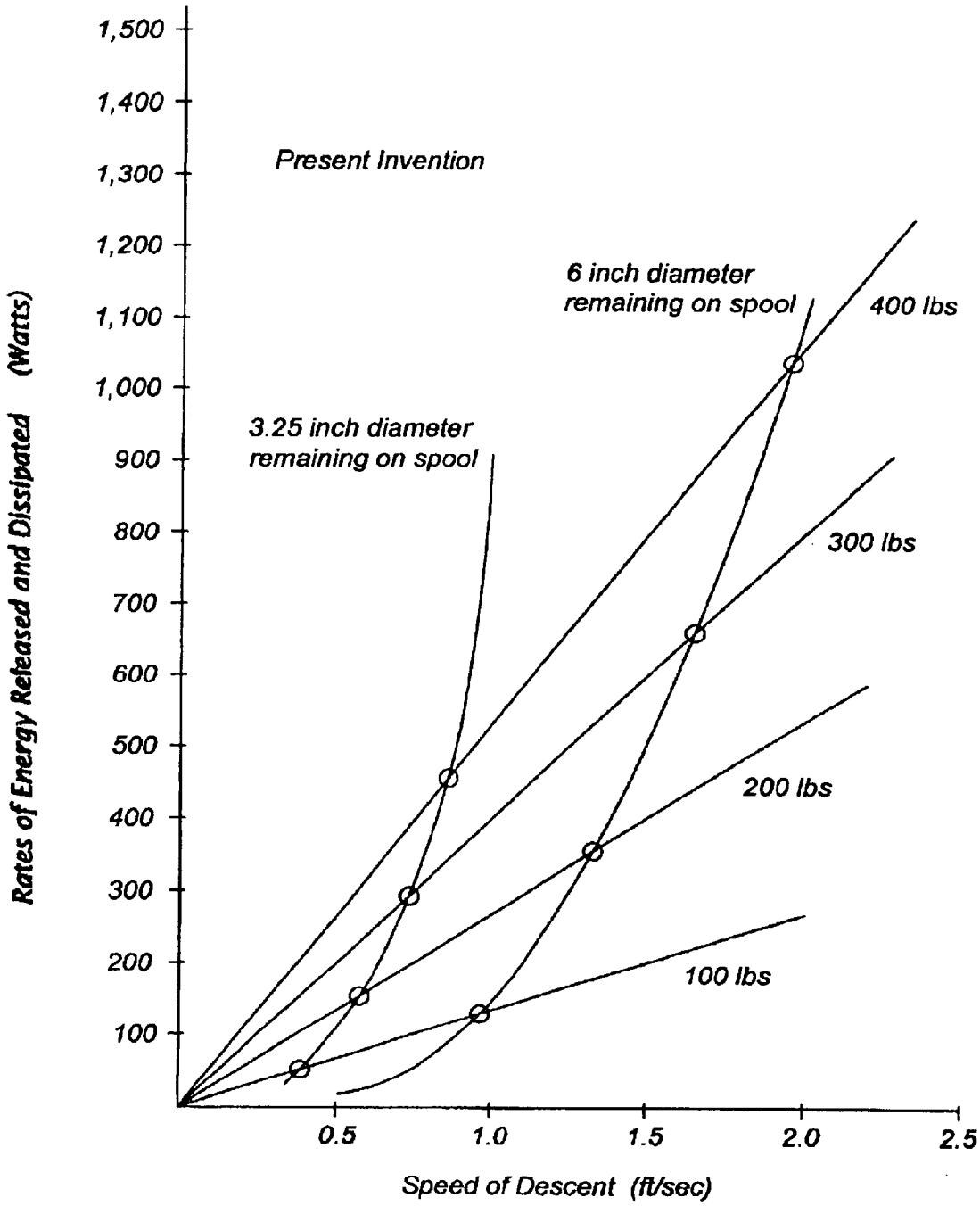
FIG. 5 is a graph showing the relationship between the rates of energy released and the rates of energy dissipated vs. the speed of descent for the preferred embodiment.

FIG. 5 shows the superposition of these curves with the previously calculated lines representing the rates of potential energy released as a function of descent speed for the 100 lb, the 200 lb, the 300 lb, and the 400 lb descending weights. As before, the intersections determine the maximum descent speeds at the beginning with a full spool, and the minimum descent speeds at the end with a depleted spool. But now unlike the ResQline system, the weight of the cable no longer remaining on the spool is subtracted from the initial total weight because it is no longer descending. This causes an additional slight slowing effect near the end, which will be most apparent for the lightest people.

Even with the smaller energy dissipating fan, a total weight of 400 pounds (a 360 pound person with a backpack of up to 40 pounds of cable and other equipment) descends at the very slow speed of 1.9 ft/sec initially (power dissipation less than 1,200 watts), then slows to as little as 0.8 ft/sec at the end. Compare this to ResQline, where a 300 lb weight descends at 29 ft/sec initially (power dissipation nearly 12,000 watts).

At the low end of the weight scale for the present invention, a total weight of 100 pounds (a 60 pound child, with up to a 40 pound backpack) descends at the very slow speed of 1.0 ft/sec initially, then slows to as little as 0.35 ft/sec at the end. These even slower descent speeds are quite desirable for children, who would most likely be the only ones who would fit into this weight category.

For weights in between, a total weight of 200 pounds (a 160 pound person, with up to a 40 pound backpack) descends at 1.35 ft/sec initially, then slows to as little as 0.55 ft/sec at the end. And a total weight of 300 pounds (a 260 pound person, with up to a 40 pound backpack) descends at 1.7 ft/sec initially, then slows to as little as 0.7 ft/sec at the end. All these descent speeds are now slow enough to insure that the person can come down safely, right alongside the building.

One additional calculation must be made to assure that the drag coefficient, $C_D$, will maintain its value of 2.3 over the whole speed range—a calculation to verify that the Reynolds number remains substantially less than $2\times10_5$. And indeed, when this calculation is performed, it shows the Reynolds number goes from a low of $0.16\times10_5$ at the very lowest speed, up to only $0.8\times10^5$ at the very highest speed. This result, plus making sure the surfaces of the semi-cylindrical vanes are smooth (in particular, the convex surfaces) provides the assurance that $C_D$ will maintain its high value of 2.3.

It has been stated (but not yet demonstrated) that the intersection of the line describing the rate of potential energy released vs. the descent speed, with the curve describing the rate of energy dissipated vs. descent speed, indicates the actual descent speed. Yet it's straightforward to show. Looking at FIG. 5, the potential energy released line for a 200 lb descending weight is seen to intersect the rate of energy dissipated curve for the 6 inch spool diameter at a descent speed of 1.35 ft/sec, showing that 366 watts is released, and 366 watts is dissipated. If a transient pushes the descent speed a bit higher, say to 1.40 ft/sec, then 379 watts is released while 400 watts is dissipated. And so the 200 lb weight slows down . . . down to exactly 1.35 ft/sec. Conversely, if a transient pushes the descent speed a bit lower, say to 1.30 ft/sec, then 352 watts is released, while only 335 watts is dissipated. And so the 200 lb weight speeds up . . . to exactly 1.35 ft/sec. As the cable plays out and the spooled diameter reduces, the dissipation curve moves to the left causing the descent speed to move lower along the fixed slope of the potential energy released line for the given weight. (Not taking into account the slight reduction in weight as the cable plays-out and no longer descends—or the slight increase in weight for the ResQline system, as the played-out cable now does descend.)

The above illustrates one of the basic principles of the present invention, that stable descent speeds will result when the slope of the curve describing the rate of energy dissipated (the power) exceeds the slope of the line describing the rate of potential energy released at their point of intersection. It is not sufficient that the rate of energy dissipated (the power) merely increase proportionally with increasing descent speed. Both the present invention and the ResQline system are seen to exhibit stable descent speeds.

Mass Evacuation With the ResQline System

The ResQline system's descent speeds are so high that any contact with the building during the descent will likely cause injury. Even their reduced landing speed of 10 ft/sec is like jumping from a two-foot platform. That's enough to break an ankle if the landing is not performed correctly. And compounding that problem, if the person falls or fails to immediately run forward upon landing, he may become ensnared in the remaining cable that continues to play down around him. However, ResQline cannot reduce their descent speeds and still maintain a reasonable evacuation rate. In order to help avoid contact with the building during the descent, they provide a "push-off" platform that extends out from the building.

However, that may have limited effectiveness as shown by the following: Assume one is on the $70^{th}$ floor of the 102 story Empire State building. About 240 people work on that floor. There are 20 windows on the north and south sides, and 14 windows on the east and west sides. Now assume there are eight ResQline systems pre-installed at eight egress windows, two on each side. Egress windows are windows that can be easily opened in an emergency. If eight ResQline systems and eight egress windows are installed on every floor of the building, then each system on the $70^{th}$ floor will have at least one system and probably two directly above it and at least two systems and probably four directly below it. So although the platforms reduce the chance of hitting the side of the building, they virtually guarantee hitting another platform which is just as dangerous (if not more so).

Yet reducing the number of systems is not an option, because typically only one side of the building (the windward side) is smoke and fire free on the lower floors, and thus suitable for building egress. So even with the assumed eight systems, only two may be operating. In the above example, 120 people line up before each of the two windows. The next person in line removes the spool of the previous person (estimate—5 seconds). Stores it in the provided storage rack (estimate—15 seconds). Places his own spool on the shaft and locks it (estimate—5 seconds). Clips the caribiner located on his harness (previously donned) onto the loop on the end of the cable (estimate—5 seconds). Climbs up onto the platform and carefully works his way out to the end (estimate—20 seconds). Then without hesitation pushes off to begin his descent, which takes 60 seconds from the $70^{th}$ floor. Then the minimum twenty foot safety factor of additional cable continues to play out to the end of the spool (estimate—2 seconds). And then it begins to rewrap until the fan stops (estimate—10 seconds). And the next person removes the spool before the cable plays out again, tugged-on by 20 pounds of cable weight hanging out the window. So even with no hesitation, no mishaps, and no delays, the whole process takes over two minutes per person. That's less than 30 people an hour per window. So, to evacuate all 120 people waiting in line at each window on the $70^{th}$ floor will take four hours. This assumes that all the above is possible without mishap—which it probably isn't, due to the aforementioned crashes into the platforms, and the following additional problems.

One of the other problems is high wind (typically present with tall buildings). The wind on the windward side will push people against the building, and into each other, possibly causing their moving cables to entangle with others, with the platforms, and with any other projections from the building.

Also, those people who are waiting for up to four hours to egress the building could be suffering smoke inhalation and carbon monoxide poisoning. Smoke will rise in the building until its temperature reduces to that of the surrounding air, and carbon monoxide will rise in the building indefinitely because it is lighter than air. It can cause panic and death, not to mention muddled thinking—which itself can cause injury and death. For instance, in the example above, a person may fail to properly secure the previous spool, whose up to twenty pounds of attached cable is trying to pull it out the window. If it should fly out the window, the spool and its approximately 1,000 feet of steel cable suddenly turns into a lethal weapon as it careens downward, not only to those descending, but also to rescue personnel on the ground.

And there's an additional problem. Some tall buildings are tapered (like the Transamerica building and the John Hancock Center). Many more are stepped (like the Sears Tower). The ResQline system is unable to cope with tapered buildings, and also unable to cope with stepped buildings because the cable continues to play out after the person has landed . . . on the ground, or on a stepped lower rooftop level still several stories above the ground. As a result, if the unfortunate person were to try to continue his descent from the lower level, he would free-fall several stories, possibly to his death.

Mass Evacuation With the Present Invention

By contrast, the present invention successfully solves all of the above problems. As was done with the ResQline system, it will be desirable to install egress windows on each floor. This avoids having to break the windows, which is dangerous for both the people doing the breaking and certainly for the people below. As in the previous Empire State building example, there would be eight egress windows on the $70^{th}$ floor, two on each side. Alongside each egress window would be an anchor box supported by a steel chain capable of supporting up to 20 tons of weight. The top of the chain will have been previously secured to the I-beam girder above the window, or a similarly strong support.

As before, the two egress windows on the windward side of the building (the side with no smoke and fire) will be used (as directed by the fire chief at the site), and 120 people will exit from each window. But this time, they just clip their caribiners to the anchor box (their carabiners are affixed to the end of their spooled cables in their already donned backpacks) and lower themselves out the window, one after the other as quickly as they can. That process should take no more than 15 seconds per person. That's 120 people in 30 minutes. (Versus 4 hours for the ResQline system.)

As before, the two egress windows on the windward side of the building (the side with no smoke and fire) will be used (as directed by the fire chief at the site), and 120 people will exit from each window. But this time, they just clip their caribiners to the anchor box (their carabiners are affixed to the end of their spooled cables in their already donned backpacks) and lower themselves out the window, one after the other as quickly as they can. That process should take no more than 15 seconds per person. That's 120 people in 30 minutes. (Versus 4 hours for the ResQline system.)

But even in 30 minutes, smoke and carbon monoxide may accumulate. Thus the present invention also includes an up to one-hour breathable air system that removes smoke, carbon monoxide, and other combustion products. Incorporated in a transparent protective helmet that can be worn even by bearded persons, it allows the person to see, hear, speak, wear glasses and hearing aids, and even use a cell phone. The helmet is a one-size-fits-all design. It is separate from the backpack, and is flexibly sealed at the neck to allow the person to move his head.

Outside the building, the scene is one of hundreds, even thousands of people (from all the floors) being gradually and safely lowered down the side of the building. Their descent speeds are all under 2 ft/sec, typically differing from each other by less than 1 foot/sec. That means it takes more than 5 seconds for one person to pass another. As they slowly pass, they can easily fend each other off (even a kick in the head is no problem because of the helmets). Any projections from the building (including the open egress windows) are easily maneuvered around. And should a cable become snagged, twisted, or even totally wrapped around other cables in the process, it is not a problem. For unlike the ResQline system, the already played-out cables in the present invention are not moving.

Also, tapered and stepped buildings are no longer a problem. The person lands gently on a lower rooftop level, stepped plateau, or ledge, walks over to the side and lowers himself over the edge. His slow descent resumes immediately as there is no slack in the cable. And the process can be repeated as many times as necessary.

Also there is no danger from lethal steel cables careening out of windows. Once the cables are attached (with the carabiner to the anchor box), they never get detached. Still, there may be some small incidental objects that people above might drop and the helmets help protect against injury from those. The helmets also continue to protect against smoke should there be a shift in the wind direction.

Finally, the landing on the ground is so gentle, it's like jumping from a height of less than an inch. That makes it easy to avoid obstacles on the ground if they exist, and it virtually eliminates the chance of injury from the landing. In a mass evacuation situation, rescue personnel can use heavy wire-cutters to cut people's cables when they land and lead them away from the landing area to clear it for others who are about to land (possibly at the rate of hundreds per minute). They could also do this on a lower rooftop below the fire, and redirect people back into building to the stairs—if safe to do so.

Detailed Description of the Preferred Embodiment

Figure 6A:
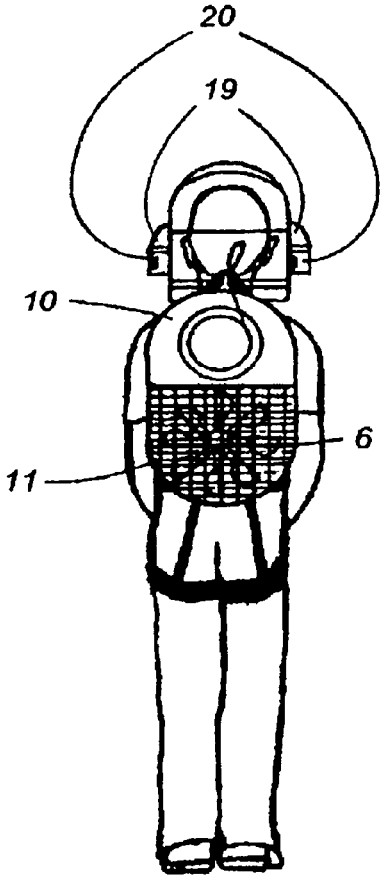
FIG. 6*a* shows the back view and FIG. 6*b* shows the side view of a man fitted with the preferred embodiment consisting of a backpack assembly, a rescue harness, and a headgear assembly.
Figure 6B:
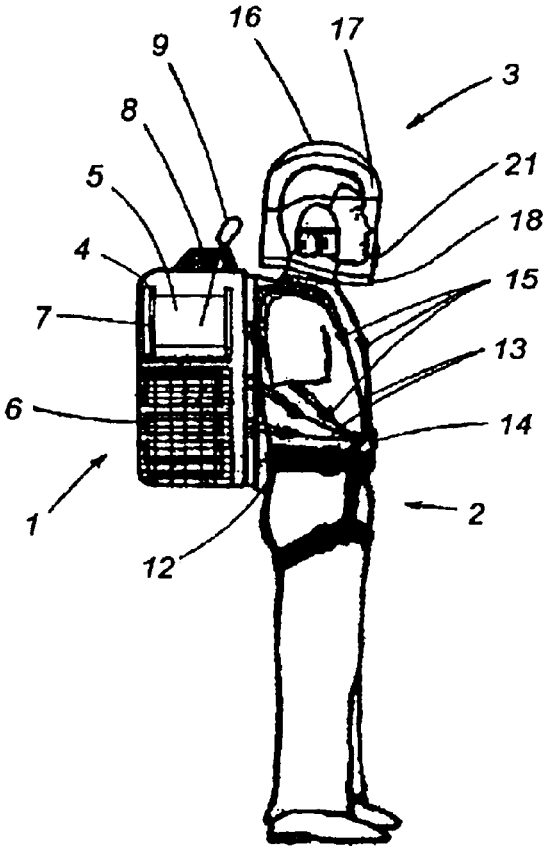

FIG. 6*a* and FIG. 6*b* show the back and side views of a 6 foot man, fitted with the preferred embodiment of the present invention, comprised of a backpack assembly 1, affixed to a rescue harness 2, plus a headgear assembly 3.

The backpack assembly 1 contains a cable spool 4, pre-wound with a full length of steel cable 5, an eight-vaned semi-cylindrical fan 6, all of the associated bearings, gears, and shafts (not visible in this figure), a de-slacker spring 7, a cable guide 8, and a carabiner 9 affixed to the free end of cable 5. The backpack assembly 1 is contained in a thin, aluminum or hard plastic casing 10, with a grillwork portion 11 that surrounds the fan 6. And to relieve any possible pressure points, a full-coverage memory-foam pad 12 is affixed to the user side of the backpack assembly 1. Eight attachment ropes 13 are also affixed to the backpack assembly 1, and secure it to the rescue support loop 14 of the rescue harness 2. Each is fitted with a tensioning device 15 that once tightened, keeps the ropes taught and the backpack assembly 1 secure prior to the descent, and the person secure during the descent. (Belts, bungees, buckles, straps, clips, tethers, rings, snaps, loops, ties, hook and loop material such as Velcro, and more may be used instead of the ropes and tensioning devices.)

The rescue harness 2 is a standard item that is readily available. The Yates Rescue Harness Model 310 and the CMC Tactical Rappel Harness are two acceptable examples. Both are one-size fits-all and the leg straps and waist straps are easily attached. Because of the leg straps, women would be encouraged to keep a pair of slacks available. Failing that, the rescue harness 2 can be put on beneath a skirt or a dress, and the rescue support loop 14 can be brought out at the top of the skirt or through the front of the dress. (The same issue would exist with the ResQline harness, or with rescue parachutes.)

The headgear assembly 3 contains a clear plastic helmet 16, a memory-foam insert 17 which fits on the top of the head and supports helmet 16 on its inside diameter (not at the top), a memory-foam neck seal 18 with a sealing skin on all but the lower side to prevent air leakage between the neck and the bottom of the helmet 16, and which allows for free movement of the head. Two canister holders 19 are located on each side of helmet 16, each of them holding two filter-canisters 20. The canister holders 19 and a mouthpiece 21 contain small flap-type check valves that block exhales through the filter-canisters 20, and block inhales through the mouthpiece 21.

Figure 7:
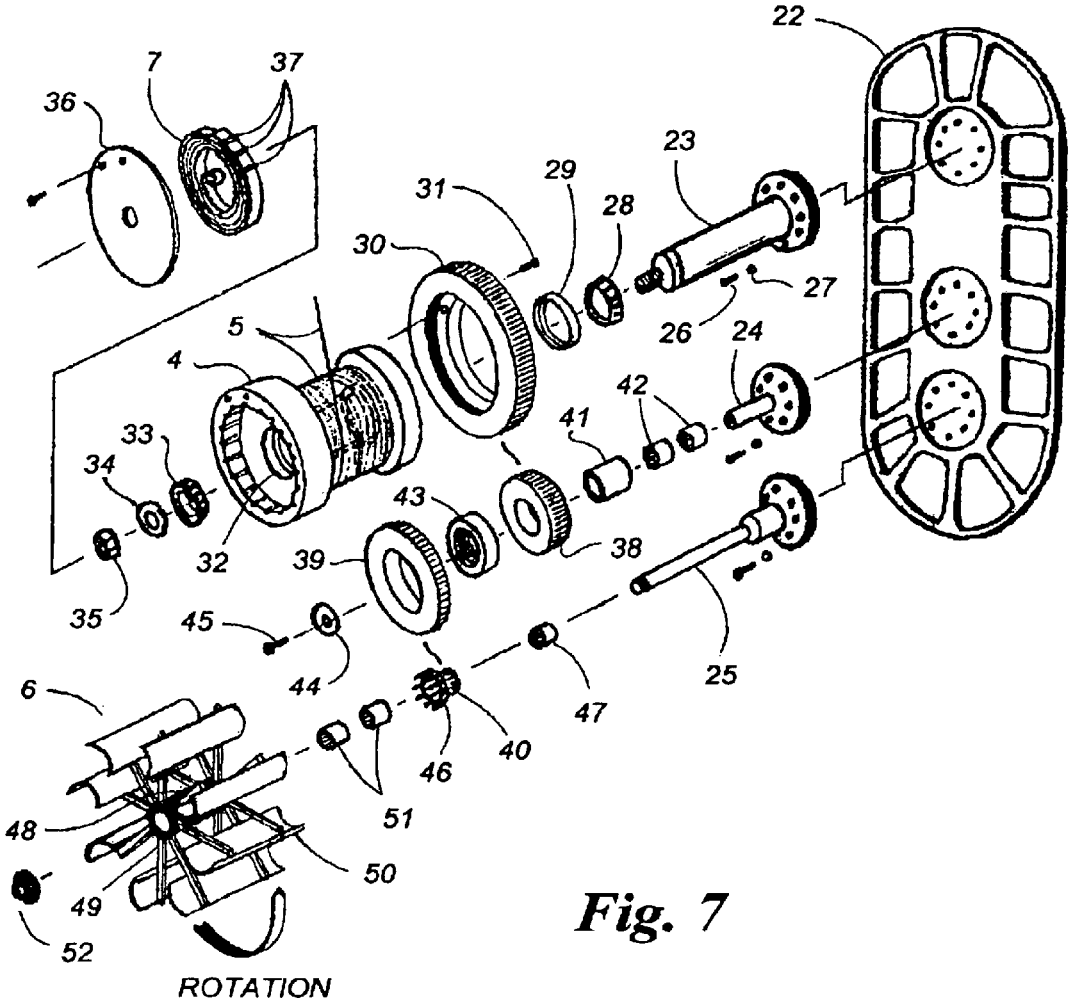
FIG. 7 shows a perspective exploded view of the working parts of the basic backpack assembly.

FIG. 7 shows a perspective exploded view of the working parts of the backpack assembly 1. Everything is mounted to the backplate 22 via three non-rotating shafts, the upper or spool shaft 23, the intermediate shaft 24, and the lower or fan shaft 25. Each shaft has a ¼ inch thick flange, which is bolted into a matching ¼ inch recess in the ½ inch aluminum backplate 22 with eight bolts 26 and eight lockwashers 27 as shown. All the shafts are fabricated of stainless steel for high modulus of elasticity and strength. The upper shaft 23 is nominally 1 ⅝ inches in diameter, and is bored out with a one-inch diameter hole for weight savings without a significant loss of bending stiffness.

Looking at the upper shaft 23, the TS type tapered roller bearing cone 28 nearest to the backplate 22 is an NTN-Bower number 336, and the mating cup 29 is number 332. The bearing cup 29 presses into a machined opening in the cable spool 4, located in the inside flanged section, not in the middle spool section. The inside flanged section fits within, and is bolted to gear #1 30 with 12 bolts 31 so that the two are forced to rotate together. Pressed into the outside flanged section of cable spool 4 is bearing cup 32, NTN-Bower number 332B, in which rides bearing cone 33, number 339, mounted in the 1 ⅜ inch diameter section near the outer end of upper shaft 23. Each of the specified tapered roller bearings is rated for 4,290 lbs of radial force and 2,010 lbs of axial thrust for 3,000 hrs at 500 RPM. All these levels are well in excess of what the bearings will be subjected to in operation. The speed is typically less than 100 RPM for less than an hour, yet could rise above 500 RPM for less than a second following a short initial free-fall, as discussed in paragraph [0121]. The upper rotating assembly is held together by a belleville washer 34 and nut 35 which screws onto the threaded end of the upper shaft 23.

The middle section of the aluminum cable spool 4 is 8 inches long, with a 3.25 inch inner diameter and a 7 inch flange diameter. In just 6 inches of that diameter, it can hold up to 1,555 feet of 3/32 diameter carbon steel wire-rope, in a flexible 7×19 configuration with 1,000 pounds minimum breaking strength—Loos & Co. part number GF 09479 (Military spec, Mil-W-83420). Alternatively, cable 5 may be a high strength polymer, or composite. A 1,555 foot cable is more than long enough to reach the ground from the highest occupied floor of the Sears Tower, or Taipei 101. The extra diameter on spool 4 allows for the addition of sufficient cable to accommodate multiple lower rooftop sections, and even taller skyscrapers yet to be built. Cable 5 exits through cable guide 8, (not shown), an aluminum block firmly affixed to the top of backplate 22. The smooth hole is flared at both ends, and is electroless nickel-plated for hardness and low friction.

At the top of FIG. 7 is shown a de-slacker spring 7 and a cover plate 36. The de-slacker spring 7 fits into the outside flanged section of the cable spool 4. Its purpose is to automatically remove any slack from cable 5 prior to the person lowering himself out of the window, and prior to any subsequent times when the person must continue his descent by lowering himself from a lower rooftop level. This is an important feature, for if there were slack in cable 5 on any of these occasions, the person would free-fall until the slack was fully taken up. In a free-fall of just over 6 feet, a person would reach the very high descent velocity of 20 ft/sec.

The design of the de-slacker spring 7 is identical to that used in a retractable dog leash—with one exception, which will be pointed out. The spring is formed of a long band of high strength steel, phosphor bronze, or beryllium copper, pre-stressed such that it would coil into a tight spiral if left alone . . . a spiral opposite that shown in FIG. 7, for as is done with the retractable dog leash, the de-slacker spring 7 is installed with its pre-stressed curvature "opposing" that of the inside periphery of the outboard flanged section of cable spool 4. As a result, it hugs the periphery of the housing, not the slotted extension of the spool shaft 23 within which the inner loop of the band fits. The exception cited above relates to the other end of the band. In the case of the dog leash, the other end of the band is permanently attached to the periphery of the housing . . . acceptable because the leash reaches its stop before the band completely winds up around the slotted shaft. But in the present application, cable 5 would wind the band fully around the slotted end of the spool shaft 4, snapping any permanent peripheral attachment long before the person had fully descended. Therefore, the other end of the band is formed with three pre-stamped triangular ridges 37 as shown, spaced to fit within triangular indentations machined all around the internal periphery at the outboard end of cable spool 4. They remain within the given indentations as long as sufficient number of turns of the band remain at the periphery to exert a sufficient radial force to hold them in. However, as the person further descends, the cable spool 4 further winds the band around the center shaft end until insufficient turns remain along the periphery to hold the little triangular ridges in place. And they suddenly slip, releasing the de-slacker spring 7 at its outer end. The slippage though quickly stops when sufficient turns have returned to the periphery to once again force the three little triangular ridges 37 into three other indentations. This process repeats over and over as long as the descent continues.

Between the condition where the band is almost entirely around the periphery (unwound condition), and the condition where the band is mostly around the slotted shaft and periodically slipping at the periphery (fully wound condition), the de-slacker spring 7 exerts a nearly constant torque on the cable spool 4, attempting to turn it in the direction that would rewind the cable. The material of the band, the length of the band, the width of the band, and the thickness of the band of de-slacker spring 7 are to be such that this torque equals approximately 10 inch-lbs, over at least 30 rotations—which would take care of at least 30 to 45 feet of slack.

Without the de-slacker spring 7, cable slack could have arisen in several ways. When carabiner 9 is attached to the anchor box, if the amount of cable 5 that is pulled out exceeds the minimum amount needed to exit from the window, cable slack would result. More slack will result if the pulling force gets cable spool 4 spinning, so that its inertia continues to turn it for a while when the force is no longer applied, contributing to slack buildup inside the backpack assembly 1 where it can't be seen. With de-slacker spring 7 exerting a constant 10 inch-lbs of torque, this rotation will be quickly stopped, and then reversed to reel in the slack. The person feels about a three-pound resistance as he pulls the carabiner 9 out a few feet, and a three-pound force trying to pull it back. He can be assured all the slack has been removed before exiting the window when he feels cable 5 pulling him toward the anchor box with that amount of force. The stated minimum of 30 to 45 feet of slack removal capability is required for two reasons. First, a person might attach his carabiner 9, and then have to go somewhere else in the room before returning. And second, that amount of slack may occur on a lower rooftop level if the person should walk over to one edge to access his situation, then decide to descend from an edge closer to his original landing place (or where a subsequent slipping of the periphery of the band occurred as he walked away from that original landing place). By trigonometry, if the lower rooftop is 200 feet down, then walking 114 feet will only pull out 30 feet of cable. That doesn't limit someone 200 feet down from walking more than 114 feet to the edge, it only means he should not end up more than 114 feet back in the direction from which he originally started if the de-slacker spring 7 is to rewind all the slack.

In FIG. 7, Gear #1 30 on the upper shaft 23 mates with gear #2 38 on the intermediate shaft 24. And gear #3 39 on the intermediate shaft 24 mates with gear #4 40 on the fan shaft 25. Gear #1 30 is a ¾ inch wide, 12 pitch, 14 ½ degree pressure-angle angle spur gear, having a 12 inch pitch diameter and 144 teeth. Gear #2 38 is a ¾ inch wide, 12 pitch, 14 ½ degree pressure-angle spur gear, having a 3 inch pitch diameter and 36 teeth. Gear #3 39 is a ½ inch wide, 20 pitch, 14 ½ degree pressure-angle spur gear, having a 5 inch pitch diameter and 100 teeth. And gear #4 40 is a ½ inch wide, 20 pitch, 14 ½ degree pressure-angle spur gear, having a 1 inch pitch diameter and 20 teeth. Aluminum is preferred for all the gears, but phenolic or magnesium may save weight.

Every rotation of gear #1 30 results in four rotations of gears #2 38 and #3 39, and twenty rotations of gear #4 40. The maximum tooth forces occur with the maximum 400 lb total descent weight, when cable 5 on cable spool 4 is at the maximum 6 inch diameter. The maximum tooth force is 200 lbs on gears #1 30 and #2 38, and 120 lbs on gears #3 39 and #4 40, which are well within the capabilities of the specified gears. The associated maximum torques are 1,200 inch lbs on upper shaft 23, 300 inch lbs on intermediate shaft 24, and 60 inch lbs on the fan shaft 25. That latter maximum torque means the eight vanes of fan 6 at their effective radius of 4.9 inches see a total maximum drag force of approximately 12.2 lbs, translating to a maximum drag force of 1.53 lbs on each semi-cylindrical vane.

When cable 5 on cable spool 4 is at the minimum 3.25 inch diameter for a 400 lb total descent weight, the tooth forces are reduced to 108.33 lbs on gears #1 30 and #2 38, and 65 lbs on gears #3 39 and #4 40. The associated torques are 650 inch lbs on upper shaft 23, 162.5 inch lbs on intermediate shaft 24, and 32.5 inch lbs on fan shaft 25. The latter torque requires a total drag force on the vanes of the eight-vaned fan 6 of about 6.63 lbs at the effective radius of 4.9 inches, or 0.83 lbs on each semi-cylindrical vane. The speed and force values cited here and in the previous paragraph provide a "feel" for the speeds and forces to which the various moving parts are subjected.

It also provides a means for demonstrating the validity of the previous energy analysis. From FIG. 5, the energy analysis showed that a 400 lb weight descends at 1.92 ft/sec when cable 5 is at the maximum 6 inch diameter on cable spool 4, and at 0.79 ft/sec when cable 5 is at the minimum 3.25 inch diameter. The 1.92 ft/sec descent rate occurs at a spool speed of 73.4 RPM and a fan speed of 1,467 RPM, with a vane velocity of 62.68 ft/sec at the effective vane radius of 4.9 inches. The 0.79 ft/sec descent rate occurs at a spool speed of 55.7 RPM and a fan speed of 1,114 RPM, with a vane velocity of 47.61 ft/sec at the effective vane radius of 4.9 inches. Now as a check, the drag forces may be calculated directly by plugging in the above vane velocity values of 62.68 ft/sec and 47.61 ft/sec respectively, into the following well known equation for drag force, and compared to the required force values of 1.53 lbs and 0.83 lbs.

$$D = \frac{C_D}{2}\left(\frac{\rho_W}{g}\right)V^2 A \tag{3}$$

Where:

D=the drag force (in lbs) for a single vane $C_D$=2.3, the drag coefficient for the semi-cylindrical shape $\rho_W$=0.078 lbs/ft$^3$, the weight density of air g=32.2 ft/sec$^2$, the acceleration of gravity $V_{6\ in}$=62.68 ft/sec, the vane velocity at the 6 inch spool diameter (for 400 lbs)

$V_{3.25\ in}$=47.61 ft/sec, the vane velocity at the 3.25 inch diameter (for 400 lbs)

A=0.1389 ft$^2$, the frontal area of the 2.5 inch=8 inch vane

Notice that the drag force in equation (3) is proportional to the square of the velocity. But because [Power=Force× Velocity], this is consistent with equation (1) which shows the drag power to be proportional to the cube of the RPM velocity term. Plugging in the above values, the drag forces are determined to be 1.52 lbs and 0.87 lbs respectively, thereby confirming the previous energy analysis. This confirmation of the energy analysis further serves to confirm the inventive principles cited herein, which combined with the principle stated in paragraph [0053] are:

That to cause a person to descend at the safe speed of 1 ft/sec instead of the unsafe speed of 10 ft/sec does not require ten times more power dissipation of an energy dissipating mechanism but ten times less, and that this slow descent speed can be achieved with a small-size energy dissipating mechanism if its rotating speed is made sufficiently great, typically greater than that of the cable spool, and that by making the energy dissipating mechanism so small that both it and the cable can be worn, it eliminates the long waiting time for the previous person to complete his descent—thus enabling many persons to evacuate quickly from the same egress point, one right after the other with no wait.

Returning to FIG. 7 after that brief yet important digression, gear #2 38 is shown to be mounted on rotating sleeve 41, which in turn is mounted on two needle bearings 42, which are themselves mounted on the non-rotating, ½ inch diameter intermediate shaft 24. Gear #3 39 is not mounted directly on sleeve 41, but is instead mounted on a roller clutch and bearing assembly 43, which is mounted on sleeve 41. The 304 stainless steel sleeve 41 is 2.0 inches long, with an I.D. of 0.688 inches and an O.D. of 1.178 inches. The whole assembly is held together by washer 44 and bolt 45.

Bearings 42 are Torrington drawn-cup needle roller bearings, number B-812, having a ½ inch bore, an 11/16 inch O.D., a ¾ inch width, a maximum working load of 3,290 lbs, and a max speed of 5,500 RPM. The roller clutch and bearing assembly 43 is Torrington number FCB-30, having a 1.18 inch bore, a 1.46 inch O.D., a torque rating of 845 inch lbs, a working load rating of 1,510 lbs, and an overrun limiting speed of 7,330 RPM. All these values are well in excess of the requirements cited previously.

Because of the roller clutch and bearing assembly 43, the torque is transmitted from gear #2 38 to gear #3 39 in only one direction. This optimizes the operation of the de-slacker spring 7 by not requiring it to stop and rewind the high speed fan 6, but merely to stop and rewind the slow speed cable spool 4, gear #1 31, and gear #2 38.

Gear #3 39 meshes with gear #4 40 located on the narrow 7/16 inch diameter portion of fan shaft 25. Gear #4 40 is welded (or bonded) to a connector ring 46, and the two form a rigid assembly. The assembly rides on needle roller bearing 47, a Torrington drawn-cup needle roller bearing, number BH-78. This ½ inch wide bearing has a 7/16 inch bore, a ⅝ inch O.D., a max working load of 1,690 lbs, and a maximum speed of 6,300 RPM. Eight precision pins connect the connector ring 46 to the fan assembly 6.

Fan 6 is a welded aluminum (or molded plastic) assembly consisting of a center tube 48, two 8-spoked support plates 49, and eight semi-cylindrical vanes 50. Tube 48 rides on two drawn-cup needle roller bearings 51, Torrington number BH-78, a ½ inch wide bearing with a 7/16 inch bore, an 11/16 inch O.D., a max working load of 1,600 lbs, and a maximum speed of 8,300 RPM. The fan assembly 6, and the assembly made up of connector ring 46 and gear #4 40, are held in placed by an end nut 52 which is screwed onto the threaded end of shaft 25. The 3.9 inch long center tube 48 has a 0.688 inch I.D., and a 1.5 inch O.D. The two ⅛ inch thick support plates 49 have a 1.5 inch diameter center section with a 0.75 inch hole at the center. Integral with, and emanating radially from the 1.5 inch diameter center section are eight equally-spaced arms (or spokes), each ¼ inch wide and extending to a diameter of 12 inches. The two support plates 49 are centered at each end of the center tube 48, aligned for perfect angular match and welded in place. At one end, eight equally spaced ⅛ inch diameter precision holes are drilled on a 1 ¼ inch diameter to receive the eight precisely located ⅛ inch diameter pins that are welded to the connector ring 46. Each of the eight vanes 50 is a 2.5 inch diameter, 8 inch long, semi-cylindrical piece of 3/32 inch thick polished aluminum. And each is welded at four places at the underside of two aligned spokes as shown in FIG. 7. Spokes of this size easily accommodate the required forces with a substantial safety factor and have little impact on the nature of the airflow.

Figure 8B:
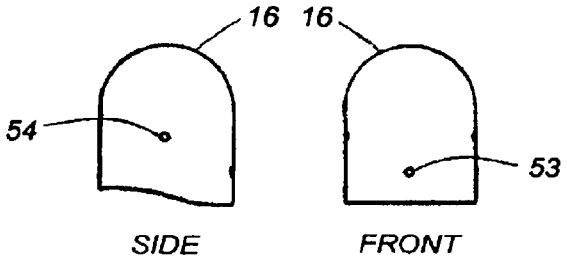
FIG. 8*b* is a side cross-sectional view of the memory-foam insert for the top of the head.
Figure 8B:
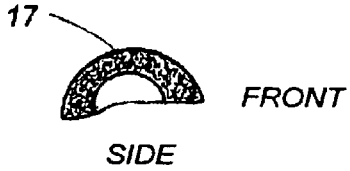
Figure 8C:
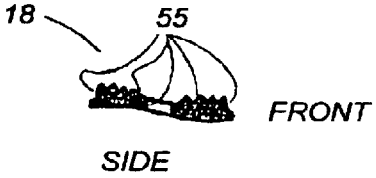
FIG. 8*c* is a side cross-sectional view of the memory-foam neck seal.
Figure 8D:
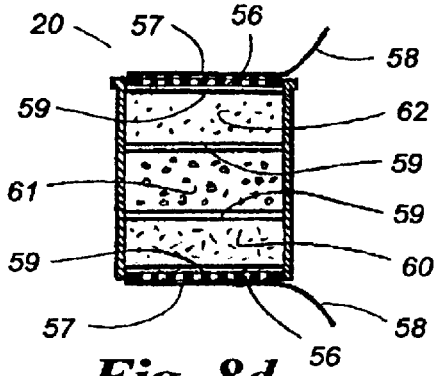
FIG. 8*d* is a cross-sectional view of the filter canister.
Figure 8F:
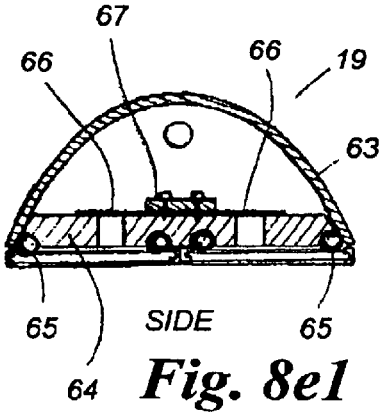
FIG. 8*f* is side cross-sectional view of the mouthpiece.
Figure 8F:
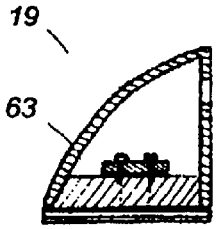
Figure 8F:
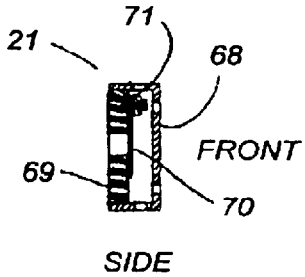

FIGS. 8*a*1 thru 8*f* illustrate the various features of the headgear assembly 3. FIG. 8*a*1 and FIG. 8*a*2 are side and front views of the basic clear plastic helmet 16 prior to the addition of the two canister holders 19, and the mouthpiece 21. FIG. 8*b* is a side cross-sectional view of memory-foam insert 17 for the top of the head. FIG. 8*c* is a side cross-sectional view of memory-foam neck seal 18. FIG. 8*d* is a cross-sectional view of filter canister 20. FIG. 8*e*1 and FIG. 8*e*2 are side and front cross-sectional views of canister holder 19. And FIG. 8*f* is a side cross-sectional view of mouthpiece 21.

FIG. 8*a*1 and FIG. 8*a*2 show the side and front views respectively of the 12 inch diameter, ⅛ inch thick, transparent polycarbonate (or high temp polysulfone) helmet 16. The front view shows a ½ inch diameter hole 53 for the mouthpiece 21. The side view shows two ½ inch diameter holes 54 for the two canister holders 19. The internal edge of all three holes is rounded so as not to tear or snag the foam insert 17 upon insertion.

The memory-foam insert 17 for the top of the head is shown in side cross-section in FIG. 8*b*. Its 12 ¾ inch outside-diameter, and 5 inch inside-diameter, give it a very supportive one inch interference fit inside the helmet 16, and a very snug, and yet not uncomfortable fit for persons with head sizes of 5 ¼ inches and up. It is molded of open cell memory-foam such, as the well known Tempurg® material by Tempur-Pedic®, or a less expensive alternative called Conform. In use, the foam insert 17 is put on before the helmet and supports it at its inside diameter, not at the top.

The memory-foam neck seal 18 is shown in side cross-section in FIG. 8*c*. It is molded of the same memory-foam material as foam insert 17. For the neck seal 18, the skin caused by the surface of the mold is left in place to form a sealing air barrier 55 on all but the bottom surface. This allows the neck seal 18 to seal against air leakage at the neck and the inside surface of helmet 16 and still act as a conformable open-cell material. It also should allow sound to pass through relatively freely for cell-phone use or speech. A ¼ inch lip is part of the molded piece to keep it from being pushed up too far into the helmet. The molded-in concentric corrugations at the top enable the skin to fold, and not have to stretch, in order for the neck seal 18 to conform into the space between the neck and the helmet 16. In use, the neck seal 18 (with front and top marked) is put on first, then the insert 17, and finally the helmet 16, already setup with four filter canisters 20.

The filter canisters 20 and their contents are similar to those employed in the Evac-U8™ Emergency Escape Smoke Hood, from Brookdale International Systems, Inc., as per the teachings of U.S. Pat. No. 5,186,165. Not used from the Evac-U8™ product are the nose clip, the in-the-mouth mouthpiece with inlet and outlet valves, the flexible hood, and the photoluminous disc which is visible in the dark. In the Evac-U8™ product, just a single canister is employed, having layers of filter materials sufficient for at least 10 minutes of protection at air flow rates of approximately 40 liters per minute—about equal to the breathing rate of an individual walking fast. In the present invention, the canister holders 19 on helmet 16 hold four such filter canisters 20 with four times the filter material for at least 40 minutes of protection, and longer at lower exertion rates. The filter canisters 20 are 2 ¼ inches in diameter, and about 2 ¾ inches long. The filter materials are contained within a plastic housing (ABS, polycarbonate or polysulfone) having two plates 56 with small openings for air inlet at the bottom, and air outlet at the top into the canister holders 19 and helmet 16. To protect the materials during storage, the openings in the plates 56 are covered with two metallic foils 57, adhesively secured to the top and bottom plates 56. Each foil 57 has a pull tab 58, so the foils can be easily removed just prior to insertion of the filter canisters 20 into the canister holders 19. The top of each filter canister 20 has a small lip that fits in the bottom of the canister holder 19 that aligns it and holds it in place.

FIG. 8*d* is a cross-sectional view of the filter canister 20 showing three layers of material between the bottom and top plates 56. Above the bottom plate and below the top plate, and separating each of the three materials in between, is an electrostatically charged fiber filter 59, capable of absorbing particulate mater such as minute particles of smoke. Above the lowest fiber filter 59 is a layer of activated carbon granules 60 (for example, Calgon type ASC Grade III, 12×30 mesh) for removing polar organic gases as found in the dense smoke of a typical fire where natural, man-made, or synthetic materials are burning. Above the next fiber filter 59 is a desiccant layer 61 to remove moisture from the air before it passes to the final layer of material. The desiccant 61 may be a zeolite type Z 3-01/3A, 8×12 mesh. The final layer of material 62 is for converting carbon monoxide to carbon dioxide, and may be carulite type 200, a copper manganese oxide hopkalite catalyst. The approximate amounts of the various materials in each filter canister are as follows in order for the four filter canisters to achieve the goal of at least 40 minutes with exertion, and up to an hour with little exertion: 10 grams of activated carbon granules 60, 55 grams of the zeolite desiccant 61, and 80 grams of the carulite catalyst 62. These materials have indefinite shelf lives as long as the protective foil end seals 57 remain in place. In use, the foil end seals 57 are removed just prior to installing the filter canisters 20 into the canister holders 19.

The two canister holders 19 are permanently affixed to each side of the helmet 16 as shown in FIG. 6. The half-inch hole in each canister holder 19 aligns with the half-inch hole in helmet 16. FIG. 8*e*1 and FIG. 8*e*2 show side and front cross-sectional views respectively of the left side canister holder 19, comprised of an outside housing piece 63, and a valve and seal plate 64. The housing piece 63 has integral front and back spring sections which guide and secure the top lip of the two filter canisters 20, and position them up against the two O-ring seals 65 located in the valve and seal plate assembly 64. On top of the valve and seal plate assembly 64 are two flat valve flaps 66, each lying atop a half-inch hole in the valve and seal plate assembly 64 across a one-inch by one-inch flat land. The two valve flaps 66 are formed of a single strip of 3 mil Kapton (polyimide) film, 3 inches long×1 inch wide, held in place in the center by a plastic block 67, 1 inch×1 inch×⅛ inch high. The block 67 is affixed to the valve and seal plate assembly 64 by four 0–80 screws. With each inhale the valve flaps 66 lift, allowing air to pass through the filter canisters 20 and into the helmet 16. With each exhale, the valve flaps 66 remain closed, and the exhaled air passes out through the mouthpiece 21.

The mouthpiece 21 is permanently affixed to the front of helmet 16 as shown in FIG. 6. FIG. 8*f* shows a side cross-sectional view of mouthpiece 21, consisting of an outside housing 68 and a valve plate assembly 69. The half-inch hole in the back of valve plate assembly 69 aligns with the half-inch hole in the front of helmet 16. A flat one-inch×one-inch land surrounds the half-inch hole at the front of the valve plate assembly 69, and is covered by a valve flap 70 formed of a single strip of 3 mil Kapton film, 1 ¼ inch long×one-inch wide, secured on one end at the top by a by a small plastic block 71, 1 inch×¼ inch×⅛ inch high. The block 71 is affixed to the valve plate assembly 69 by two 0-80 screws. The outside housing 68 contains two circular rows of small holes to allow the exhaled air out, one row located on a 1 ½ inch diameter at the front and another row around the periphery. With each exhale, valve flap 70 lifts outward, allowing spent air and moisture to pass to the outside. With each inhale, valve flap 70 remains in place, forcing the inhaled air to come in through the filter canisters 20.

The headgear assembly 3 should be put on in the following order: First the memory foam neck seal 18, with the corrugated shiny skin at the top and the lower part in the front (marked top and front), fitting snugly but not uncomfortably around the neck. Then the memory foam insert 17, put snugly on the head with the front part resting just above, but not covering the eyes. Next, the protective foil seals 57 are removed top and bottom from four filter canisters 20 by pulling the tabs 58. Then the filter canisters are inserted in the helmet 16, two in each canister holder 19, and the helmet 16 is slowly pulled down over the head. But not all the way down, for although the memory foam insert 17 supports the helmet at any height, it will not easily allow it to be raised without redoing the insert 17. When the helmet 16 is low enough, the memory foam neck seal 18 is pushed up into the bottom of the helmet all the way to the lip. Then, if helmet 16 feels too high, it can be further lowered. The headgear assembly 3 should be put on before the backpack assembly 1 if the quality of the air is in doubt.

Figure 9A:
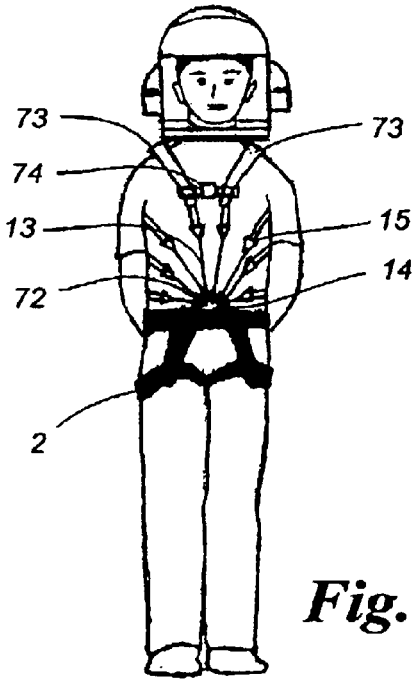
FIG. 9*a* shows the front view of a man fitted with the preferred embodiment with a particular attachment arrangement.
Figure 9B:
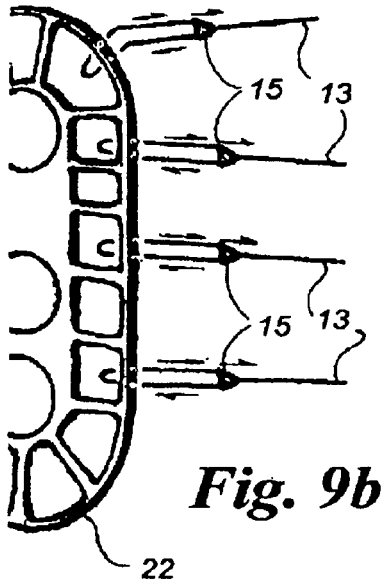
FIG. 9*b* show how the eight attachment ropes move within holes in the backplate.
Figure 9C:
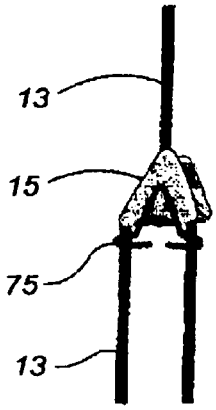
FIG. 9*c* shows a closeup of the tensioning device.
Figure 9D:
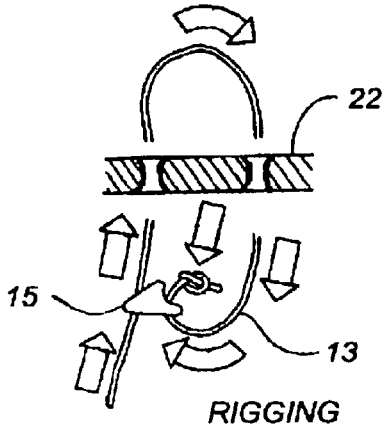
FIG. 9*d* shows how the tensioning device is rigged.
Figure 9E:
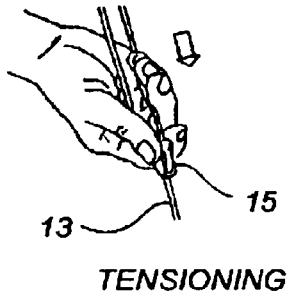
FIG. 9*e* shows how the tensioning device is tensioned by the user.

The rescue harness 2 must be put on before the backpack assembly 1. Though the backpack assembly 1 is bigger and heavier than a typical backpack, it is easy to put on if its container is stood upright on a desk. From that position, the attachment ropes 13 can be brought around the body, affixed to the rescue support loop 14 with their spring clips 72, and tightened using the tensioning devices 15. The attachment is complete when the two shoulder straps 73 are brought together with the shoulder-strap belt 74 as shown in FIG. 9*a*. The shoulder straps 73 are fixed to the backplate 22 of the backpack assembly 1 and contain a bottom sleeve with memory foam and a top sleeve to guide the shoulder attachment ropes. For nighttime use, two penlights aiming downward can be clipped onto the shoulder straps to provide light for the descent (and back-lighting for rescuers to see the descending person). As shown in FIG. 9*b*, none of the attachment ropes 13 is fixedly attached to the ½ inch aluminum backplate 22. Instead they move within machined holes in the backplate 22 as the tensioning devices 15 are tightened. The holes have rounded edges and are smoothed to avoid possible tearing of the 3/16 inch diameter attachment ropes 13. These nylon (or polyethylene) ropes are capable of a significant stretch, which helps to keep them taught even with shifting weight. FIG. 9*c* shows a closeup of the tensioning device 15. It is a modified version of a standard item called Line-Lok® used for tensioning small ropes. The modification is the addition of a small metal rope-guide 75 at the back end, to prevent an inadvertent release—normally achieved by separating the two adjacent ropes that emanate from the back end. FIG. 9*d* shows how the Line-Lok® tensioning device 15 is rigged. And FIG. 9*e* shows how it is tensioned by the user. Just one small nylon Line-Lok® device could easily support a 200 lb man, and eight of them are used here.

An Anchorage for Mass Evacuation

For just one or two persons, a special anchorage is not required. The space around open-door hinges, or desks and other massive objects in the room may serve as an anchorage to loop a steel cable around, to which carabiner 9 may be clipped. But in a potential mass evacuation situation, with a hundred or so persons having to exit through one window, a special anchorage is indeed required alongside each egress window. With 120 persons, potentially averaging 330 lbs with all their gear, the anchorage must be capable of supporting not just 120 carabiners 9, but 20 tons. (For those cases where the more likely average of 200 pounds per person can be justified, 12 tons will suffice.)

A steel I-beam skeleton constructed of horizontal girders and vertical columns frames the exterior of most high-rise office buildings. (One exception was the World Trade Center towers.) Thus, a steel I-beam girder likely exists above every potential egress window. It's an I-beam capable of easily supporting 20 tons. Standard girder clamps may be obtained which hold a 20 ton working load, adjustable to beam flange sizes from 8 inches to 24 inches in width. Girder clamp 76 is shown in FIGS. 10*a*1 and 10*a*2 with a built-in shackle 77 at the bottom. These girder clamps 76 are to be attached to the bottom flange of the I-beam above the ceiling next to each egress window. (The top flange is being used to help support the floor above.) To shackle 77 of girder clamp 76 is attached another shackle 78 whose clevis pin 79 supports the chain 80 at the top, a chain rated for a proof load of 30 tons. Chain 80 hangs down through a slot in the ceiling tile that allows movement of chain 80 toward the window. The chain hangs down along the exterior wall next to the egress window. In buildings that have continuous glass exteriors there may be no exterior walls, only exterior columns. There, the selected egress windows should be those located next to exterior columns. In concrete frame high-rises having no steel girder, the anchor box (described below) which is normally affixed to chain 80 may be affixed to a steel sleeve, which is fitted to an exterior column.

Figure 10C:
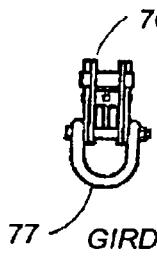
FIG. 10*c* shows the entire setup installed next to an egress window.
Figure 10C:
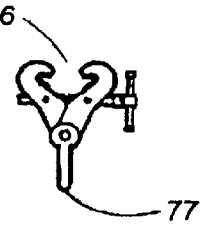
Figure 10C:
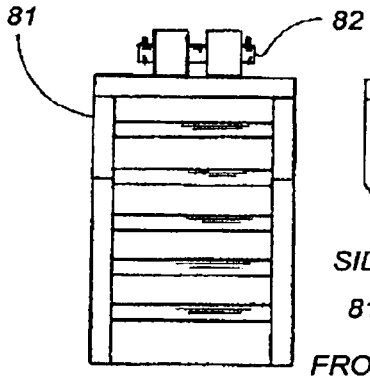
Figure 10C:
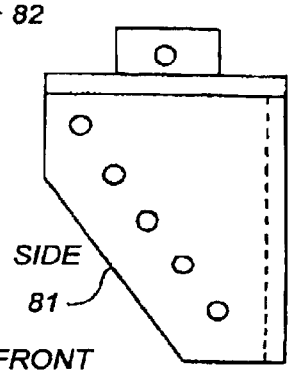
Figure 10C:
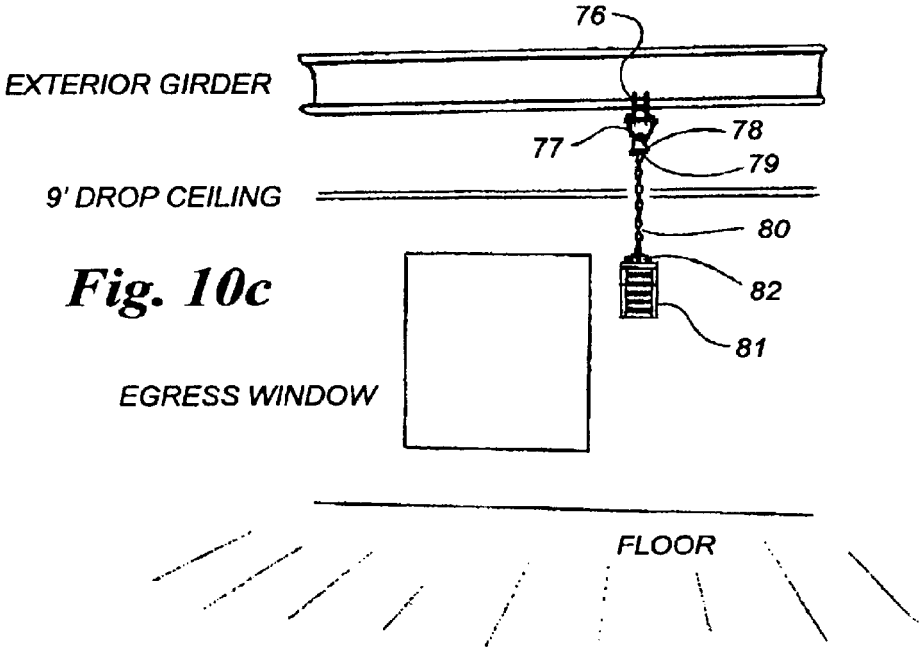

FIGS. 10*b*1 and 10*b*2 show the anchor box 81 which attaches to the bottom of chain 80, and to which each person attaches his carabiner 9 before exiting the window. It can accommodate the carabiners of 120 persons, and support 20 tons. Anchor box 81 is a 21 inch high, 12 inch wide structure, having one-inch thick steel plates at the back and the sides. At the front there are five one-inch diameter steel rods that span the two sides. The lowest rod is 4 inches from the wall and 3 inches from the bottom. The next rod up is 6 inches from the wall and 6 inches from the bottom, the next is 8 inches from the wall and 9 inches from the bottom, the next 10 inches from the wall and 12 inches from the bottom, and the last is 12 inches from the wall and 15 inches from the bottom. At the top, chain 80 connects to anchor box 81 with a one inch diameter clevis pin 82 having a center span of one inch. FIG. 10*c* illustrates an entire setup installed next to an egress window. The anchor box 81 is oriented with the rods facing out. The carabiners 9 are clipped-on one at a time, beginning with the rod at the bottom. The first person clips on his carabiner 9, pushes it over to the window-side, and then exits. The others follow suit until approximately 25 fill the first rod. Then the second rod is filled, then the third, then the fourth, and finally the fifth—if needed. The anchor box 81 is shown hanging on an exterior wall, next to the egress window. Had the egress window been situated next to an exterior column wall, the anchor box 81 could function equally well hanging on the exterior column wall. The girder clamp 76, the hanging chain 80, and the anchor box 81 must obviously be in-place and ready before the need for them might arise. For aesthetic purposes, the chains 80, and the anchor boxes 81 may be concealed by panels or drapes as long as they are readily accessible when needed.

Figure 11A:
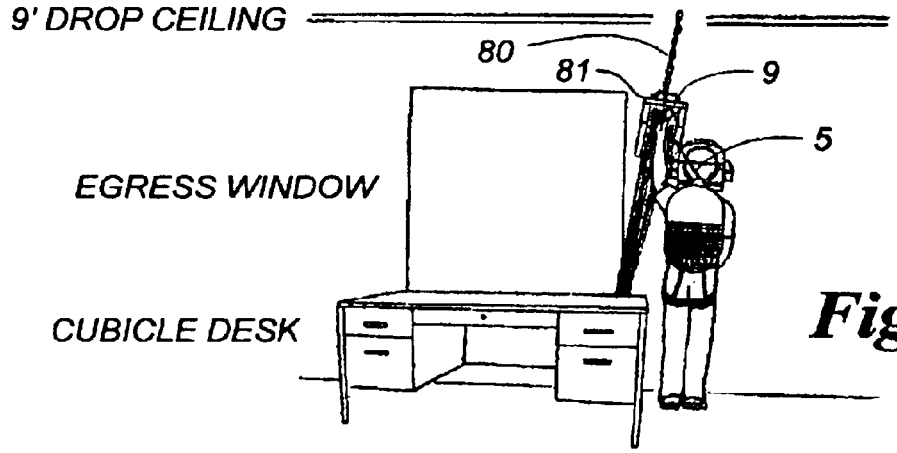
FIG. 11*a* shows a person clamping his carabiner onto the anchor box prior to exiting the window.
Figure 11B:
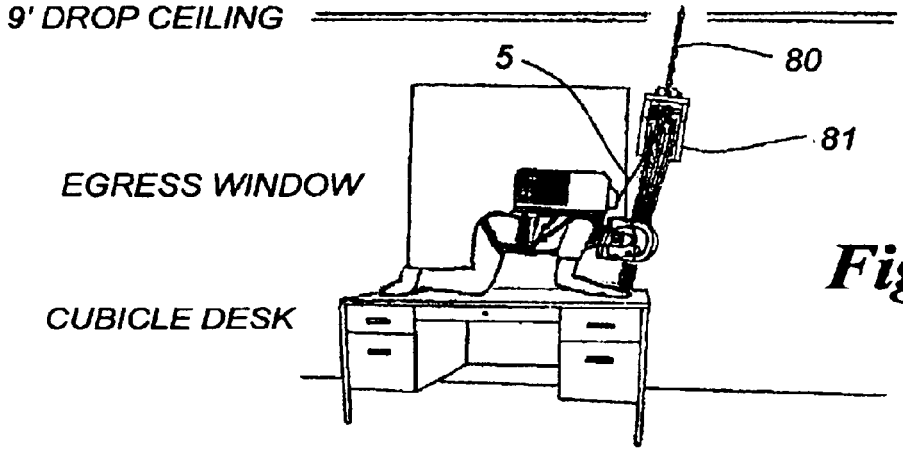
FIG. 11*b* shows the person backing toward the window.
Figure 11C:
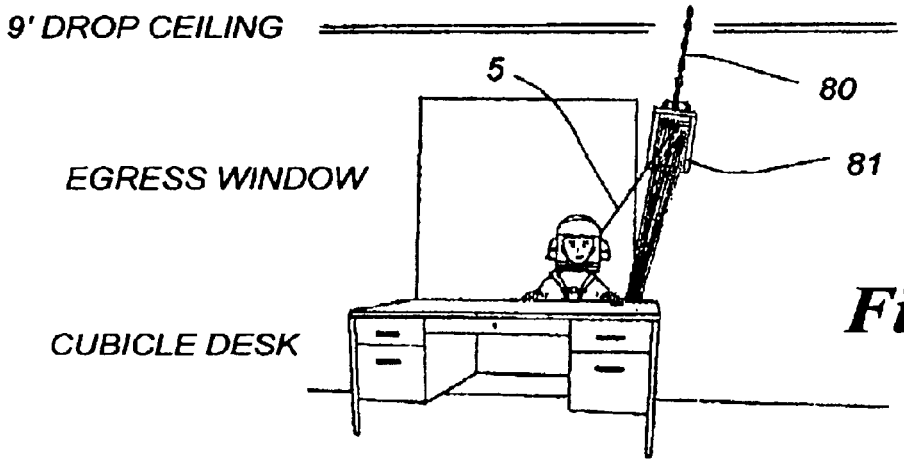
FIG. 11*c* shows the person about to let go and begin his descent to safety.

As an aid, a standard metal desk may be pushed over to the egress window in the event of a fire emergency to assist in the evacuation process. In FIG. 11*a*, the $120^{th}$ person is shown clamping his carabiner 9 onto anchor box 81 prior to exiting the window. He is part of a four-person, trained, volunteer employee-team that assisted the 116 others out the window. Now, one half-hour after the evacuation began, all of them (and his three comrades too) have exited, and he is the last one. Note all the carabiners 9 and cables 5 of the persons who have already exited. By situating the anchor box 81 alongside the window rather than above it, all of their cables 5 are nestled into just one corner of the window opening, thereby keeping the opening free—no matter how many persons need to exit. In FIG. 11*b* the $120^{th}$ person is now crouched on top of the desk, slowly backing toward the window. Notice how his de-slacker spring 7 is keeping his cable 5 taut. In FIG. 11*c*, he has totally backed out the window, and is holding onto the desk, about to let go and begin his own slow descent, soon to join the hundreds, and possibly thousands of others (from other floors too), safely on the ground.

Alternative Embodiments

The alternative embodiments of the present invention presented herein describe alternate mechanisms for dissipating the energy—each adhering to the broad inventive principles described earlier in detail, and summarized in paragraphs [0053] and [0081]. It follows, therefore, that the practical realization of each of the alternative energy dissipating mechanisms still involves making them rotate faster than cable spool 4.

The first of the alternative embodiments makes use of a permanent magnet electric generator and a bank of resistors to dissipate the energy. The generator simply replaces the fan 6 in the preferred embodiment. In this alternative, the rate of energy dissipated—or the power—is proportional to the rotational speed squared, not the rotational speed cubed as is the case with the preferred embodiment. (That is because the voltage is proportional to the velocity, and the power is proportional to the square of the voltage [$P=E^2/R$], and therefore the power is proportional to the square of the velocity.)

As a result, for a given power resistor value (R in the above equation), there is a wider range of descent speeds covering the full weight range than is the case with the preferred embodiment. But since resistor values can be changed, the range of descent speeds can be made quite small by breaking up the full weight range into smaller weight ranges and assigning a different resistor value to each, selectable by means of a switch. To best accomplish this, eight weight ranges (each with its own corresponding resistor value) are required. The backpack casing becomes an all-aluminum shell (like half an aluminum case), and the wirewound power resistors are mounted on the inside of that shell with a suitable heat-sink material to augment the heat transfer process. The highest resistor value would correspond to the lowest power dissipation and the lowest weight range. Assuming a backpack weight of 40 lbs (suitable generators can be had for under 5 lbs), the following table suggests the eight total weight ranges and the corresponding person weight ranges. Note that the width of the ranges rises proportionally with the weight.

| Range # | Total Weight (lbs) | Person Weight (lbs) |
|---|---|---|
| 1 | 90 to 110 | 50 to 70 |
| 2 | 111 to 133 | 71 to 93 |
| 3 | 134 to 162 | 94 to 122 |
| 4 | 163 to 196 | 123 to 156 |
| 5 | 197 to 235 | 157 to 195 |
| 6 | 236 to 282 | 196 to 242 |
| 7 | 283 to 338 | 243 to 298 |
| 8 | 339 to 408 | 299 to 368 |

If the generator that replaces the fan of the preferred embodiment is designed to put out 48 volts at 1,250 RPM, and all the other design parameters are kept the same as previously indicated, and assuming a very low output impedance for the generator, then the following values for the power resistors for the eight weight ranges will place all the descent speeds between 1.5 ft/sec and 1.8 ft/sec initially at the 6 inch spooled diameter and less than 1 ft/sec near the end at the 3.25 inch spooled diameter: Range 1] 10.00Ω; Range 2] 8.42 Ω; Range 3] 6.96 Ω; Range 4] 5.80 Ω; Range 5] 4.82Ω;
Range 6] 4.02 Ω; Range 7] 3.35 Ω; and Range 8] 2.79 Ω. And as was the case for the fan of the preferred embodiment, the steady-state power is kept below 1,200 watts, and the steady-state generator speed is kept below 1,500 RPM.

One potential problem, of course, is that each person will have to correctly (and honestly) select their weight range on an 8-position rotary switch on their backpack so it can apply the proper power resistor before descending. That by itself is sufficient reason to opt in favor of the preferred embodiment. But another reason is the loss of "fail-safeness" due to the possibility of poor solder joints, wires becoming dislodged, resistors burning out, and generator windings shorting or opening. And also, there is greater complexity and cost.

A second alternate to the preferred embodiment utilizes an adjustable eddy current brake as the energy-dissipating mechanism. Like the generator and resistors, the adjustability is necessary for different weight ranges because the braking force is proportional to the speed, and so the braking power is proportional to the square of the speed. U.S. Pat. No. 5,711,404 teaches about such a brake. Its rotor is made of a metal conductor. Its stator is a plate with permanent magnets. The clearance between the two is adjusted by having the user make a mechanical setting prior to his descent. The fact that the device is totally mechanical eliminates the potential electrical reliability problems cited for the generator and resistors above. However, it still requires each user to make an honest weight assessment, and a corresponding accurate mechanical setting.

The use of a simple friction brake for the energy-dissipating mechanism is not an acceptable alternative because the braking force is independent of speed, thereby making the braking power merely proportional to speed. So the requirement spelled out in paragraph [0053] for a stable descent speed would not be met. And since static friction is greater than dynamic friction, such a device could easily stop in mid-descent, leaving the person stranded. Several alternative energy-dissipating mechanisms that do meet the requirement of paragraph [0053] (including an automatic governor brake), could be used as long as the other inventive principles summarized in paragraph [0081] are also met.

Other Issues

There is the issue of the egress windows. Before Sep. 11, 2001, most people in their right mind would never conceive of exiting a tall building through an upper floor window. Yet virtually every new scheme for a supplementary means of escape requires it. And to illustrate that it is feasible to change a few windows in even the tallest of buildings, one need only look at a project taking place in the Sears tower where TrizecHahn Corporation has begun the task of replacing all of the building's 16,000 windows with energy efficient laminated safety glass made of a new DuPont™ Butacite® polyvinyl butyral interlayer. Overnight crews work from 6 p.m. to 6 a.m. to avoid tenant disruption. The completion date for the project is scheduled for late 2007. If that sort of effort can be justified to reduce building cooling costs and exterior noise, and help protect carpet and furniture against fading, then surely building managers can justify changing a few windows to protect their tenant's lives and reduce their anxieties. And reducing tenant anxieties can help justify costs through improved occupancy rates.

The weight of backpack assembly 1 can be a problem—though not so, once one is descending. For then the user is suspended from the backpack, not supporting it. Forty pounds may seem like a lot of weight and yet it is no more than what many hikers carry in their backpacks . . . and not a lot more than what some children carry to school. Still, to get down to that weight requires drilling out the mechanical parts where feasible. Plus substituting phenolic, magnesium, or other light-weight material for the spool, gears, and backplate would eliminate much of their weight. Or switching to a belt drive in place of the gears (as long as the belts are made redundant to maintain fail-safeness). A major portion of the 40 lb weight is the 1,550 ft long steel cable (for the 110 story Sears tower). It weighs 26 lbs (1.7 lbs per hundred feet). If just enough cable is installed on the cable spool for the particular height where it is to be used (See paragraph 128), while taking into account any lower rooftops that must be traversed, then clearly a significant weight savings can be realized for most situations.

Certainly, the apparatus described herein is not limited to large workplace environments. High-rise apartments and hotels are also areas where this life-saving apparatus can be put to use. In these cases, with just a few people exiting from their apartments or rooms, the anchorage need not be nearly as robust as described above. Indeed, with many massive and sturdy objects already in the room, it is likely that no special anchorage need be installed.

Children will need to be helped-on with the apparatus and may have to be lowered out the window. Very small children and infants cannot use the indicated embodiments as described above. However, a small bullet-shaped "cocoon" can be designed having all of the features of the present invention, including the air filtration system in a top cover to "seal" the cocoon in which the infant or small child would descend, possibly swathed in a heat-protective insulating blanket.

Peripheral aids may improve the usability of the indicated embodiments. For example, heavy-duty gloves to fend off the exterior of the building, slowly passing by; a guide rope affixed to the anchor box, extending a few feet out the window to facilitate exiting from the window; and a Totes®-like, small-when-closed, easy-open, easy-close, metalized-foil, heat-deflecting umbrella-type shield, attached to the side of the harness belt on a retractable cord to be deployed if needed when passing the fire floor(s). An alternative to the heat-deflecting shield could be coveralls made of an insulating, fire-resistant material such as Nomex®, to be put on over existing clothing before donning the apparatus. Heat protection won't be needed on the windward side, but may be on a non-windward side. For although the preferred embodiment's descent speed inherently increases with a major increase in air temperature [see equations (1), (2) and FIG. 5], that speed increase will be too minor to carry a person safely through outward licking flames. However, one practical means for automatically and drastically increasing the descent speed through intense heat zones is described in paragraph [0125].

Initial free-falls pose another potential danger. But not when the anchor box 81 (or whatever is serving in place of the anchor box) is located high-up and adjacent to the egress point as shown in FIG. 11, and when cable 5 is taut prior to the descent (as it will be, because of de-slacker spring 7). In that case there will be no initial free-fall, for the cable will play-out to drive the fan even before it reaches its final support position on the window ledge. But in the case where the anchorage is located well inside the room—or where it is not located above the railing when one exits from a balcony—then even with a taut cable, there will be a short free-fall until the taut cable can come to rest on the window ledge or railing and the cable begins to play-out to drive the fan. A one-foot free-fall will cause the descent speed to build up to 8 ft/sec; a two-foot free-fall to more than 11 ft/sec; a three-foot free-fall to nearly 14 ft/sec; and a four-foot free-fall to about 16 ft/sec. At the end of the free-fall, fan 6 will be automatically accelerated up to the higher speed to quickly slow the person to the proper descent speed for his total weight. Unfortunately, this process can cause a high transient-force to build-up in the cable that may exceed its 1,000 lb minimum breaking strength. A potential solution would be to install a load-limiting energy-absorber in-line with the cable Oust below carabiner 9) whenever the anchor location cannot be assured to be above and adjacent to the exit point. Several simple, inexpensive, and effective energy-absorbing devices are commercially available and commonly employed by mountain-climbers to safely dissipate the kinetic energy of a short free-fall. One such device is the small Yates "Zipper Screamer" Load Limiting Sling. Even with its 6-inch tear-away sleeve, it weighs only 3 ounces. Inside are two parallel webs, each one folded over and stitched to itself with three parallel rows (for a total of six rows) of a special tear-stitch such that when the force on the webbing reaches a certain value the stitches begin to tear out, extending the webbing length and absorbing energy in the process. For the Yates Zipper Screamer, the activation force is 600 lbs, the maximum extension is 2 feet, and the load strength of the web when fully extended is 6,000 lbs.

The following numerical example will better illustrate how it works. Say a 260 lb man (with his 40 lb backpack) is about to escape from his hotel window, for a combined weight of 300 lbs. His pack came equipped with the small Zipper Screamer Load Limiting Sling installed between the end of cable 5 and carabiner 9. Following the instructions posted in his room, he attaches carabiner 9 to a suitable anchorage inside the room, walks over to the window and opens it, slides the desk over to the open window, climbs up and backs out the window. All the while, cable 5 remains taut. Nevertheless, until cable 5 becomes supported by the window-ledge, he free-falls a distance of two feet, and his descent speed reaches 11.35 ft/sec. At the end of the free-fall, his cable spool (having an initial spooled diameter of 6 inches) begins to turn. When the rotational speed of fan 6 gets to only 1,797 RPM, the cable force will have reached 600 lbs, and the Zipper Screamer's stitching begins to tear, keeping the cable force at approximately 600 pounds for about 0.28 seconds while the man is decelerated to 2.35 ft/sec. During that 0.28 seconds, he descends 1.92 feet (a 1.26 ft extension from the Zipper Screamer and 0.66 ft from the cable spool). At the end of the 0.28 seconds, the Zipper Screamer extends no further, and fan 6 (all by itself) takes the force from 600 lbs down to 300 lbs, and the descent speed goes from 2.35 ft/sec down to 1.66 ft/sec (the stable descent speed for the total weight of 300 lbs). This example shows that the small Zipper Screamer can successfully keep the cable force from going above 600 lbs, when a 300 lb total weight (i.e., a 260 lb person with a 40 lb backpack) free-falls two feet. For longer free-falls or for heavier persons, two or more Zipper Screamers may be ganged in series.

Although multiple Zipper Screamers ganged in series can keep the cable force below 1,000 pounds following most short initial free-falls, there nevertheless is a better solution—one that works with a 360 pound person for any number of free-falls, of any length, and doesn't require connecting multiple devices (which could be misconnected). It is a built-in, spring-clutch torque-limiter installed between the cable spool and gear #1. Previously, the spool and gear #1 were bolted together with twelve bolts 31, as shown in FIG. 7. The basic concept of the proposed torque-limiter is the same as that utilized by the Ringspann RT Series Belleville Spring Torque Limiter and the Ruflex® Friction Torque Limiter, except that the Belleville spring is replaced by two diaphragm springs. These two identical springs have built-in friction-linings that grip each side of a modified gear #1 on its new inner web with a large preset axial force so in normal operation, torque is transmitted from the spool without slip. However, if the torque should exceed a preset value (determined by the axial force, the geometry of the linings, and their coefficient of friction), slip will occur limiting the torque to the preset value. Energy is still dissipated by the fan (now driven at a fixed speed determined by the slip torque), and also by the torque-limiter through its slipping friction. As the descent speed slows, the slip speed reduces, eventually reaching zero where gripping automatically returns. The slip torque is set such that the cable force will be high enough to decelerate the heaviest person, and low enough to still protect the cable.

Figure 12:
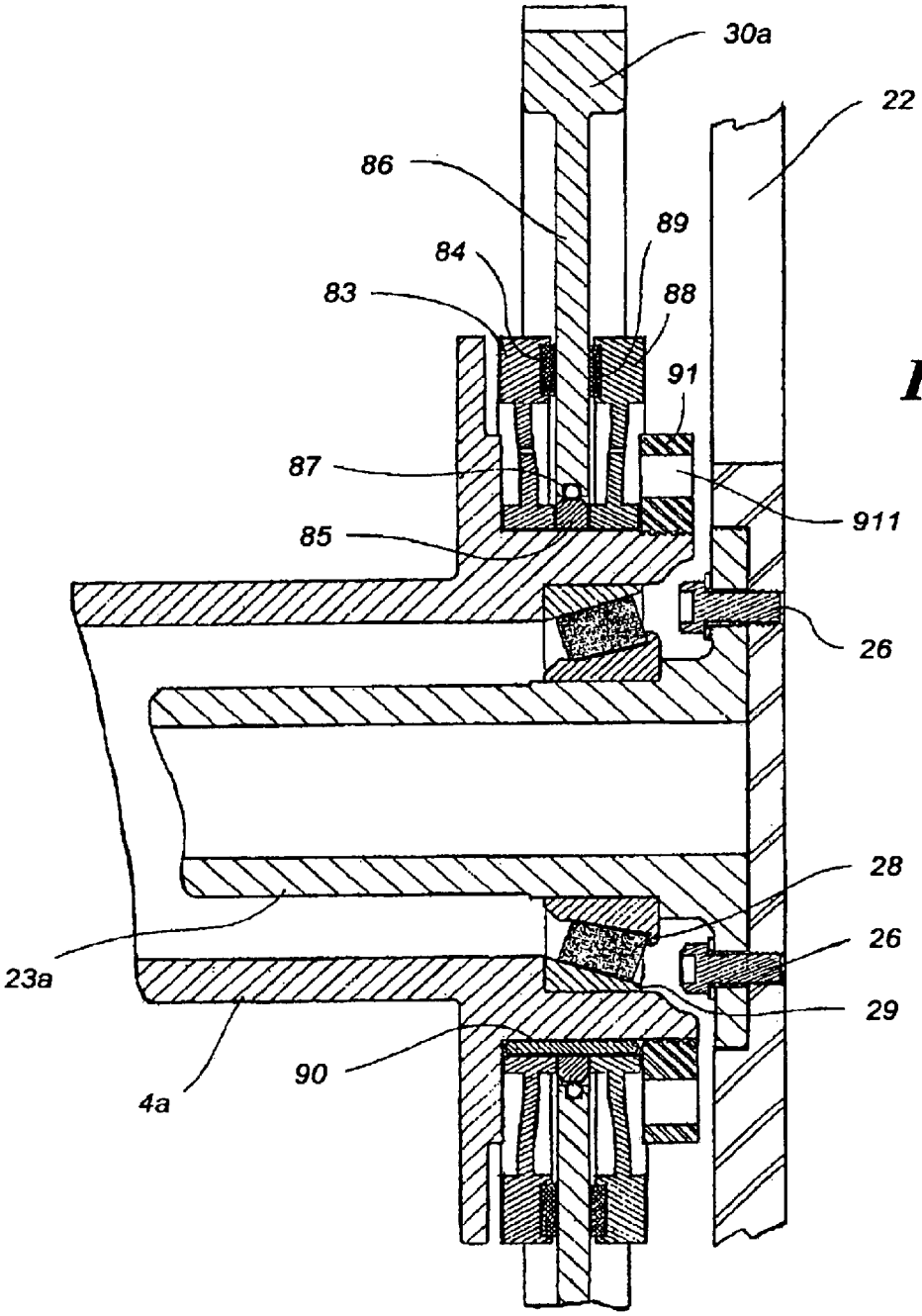
FIG. 12 shows the "as-assembled" partial cross-sectional view of the built-in torque-limiter mechanism, with the associated mating parts.

As was done previously for the basic configuration of the invention, a detailed design is carried out to demonstrate the practicality of employing the torque-limiter in this application. FIG. 12 shows the new assembled partial cross-sectional view of the modified cable spool 4*a*, the modified shaft 23*a* (now about a tenth of an inch longer), the modified gear #1 30*a* (now with a supporting web), the roller cone 28 and mating cup 29 of the inboard tapered roller bearing, the backplate 22, the eight mounting bolts 26, (two shown), and the various parts of the torque-limiter, located on the inboard end of the modified cable spool 4*a*. From left to right is shown the outboard diaphragm spring 83 with its friction-lining 84, the spacer ring 85 and the supporting web of gear #1 86 with its Teflon O-ring 87, the inboard diaphragm spring 88 with its friction-lining 89, the key rod 90, the threaded ring 91, and the locking-pin (not shown).

The two diaphragm springs 83 and 88 are identical, and they house identical friction-linings 84 and 89. Each spring has an inner hub, a diaphragm, and an outer hub which holds the friction-lining. The inner hub's bore is 4.002 inches, giving it a close slip-fit on the 4.000 inch diameter of the modified cable spool extension. The inner hub's outer diameter is 4.400 inches. The diaphragm extends from the 4.400 inch diameter to a 6.000 inch diameter. And the outer hub extends from the 6.000 inch diameter to a 7.000 inch diameter. The diaphragm is 100 mils thick (0.100 inches), centered within the 0.380 inch axial width of the hubs. A single, small 1/16 th inch diameter hole is drilled through the diaphragm at its lowest-stress 5.20 inch diameter to eliminate any possible air pressure build-up during activation of the torque-limiter. One face of each outer hub is grooved 90 mils deep, extending from the 6.125 inch diameter to the of 6.875 inch diameter. This allows for the bonding-in of the friction lining, which is 0.125 inches thick, and which therefore protrudes 35 mils (0.035 inches) from the face of the outer hub. To avoid tight tolerances on the 90 mil depth and 125 mil thickness, a thicker friction-lining may be utilized and machined down to the exact 35 mil protrusion after it is bonded in.

Modified gear #1 30*a* has a 250 mil inner web, axially centered on its ¾ inch wide tooth section. The purpose of the web is to provide an area for the friction-linings to act upon, and to support gear #1 radially, keeping it centered when the friction-linings are slipping. To accomplish that, the bore of the 250 mil thick web contains a groove for the Teflon O-ring 87, (Parker size #246, which has a 4.484 inch I.D., a 4.762 inch O.D., and a 0.139 inch cross-sectional diameter). Since the O-ring isn't to seal pressure, it is not the typical O-ring groove with an axial clearance. Instead, the groove provides an axial compression of the O-ring and an above-normal radial compression when the web and O-ring are installed over spacer ring 85 as an assembly. The gear web and spacer are both 250 mils thick, so the gear/O-ring/spacer assembly may be pressed together on a flat surface. (The spacer has a small chamfer at each end to facilitate that assembly.) Like the diaphragm springs, the spacer's bore is a close slip-fit on the modified cable spool extension. All three bores, as well as the modified cable spool extension's outer surface have an axial groove, 0.096 inches wide and 0.048 inches deep to accommodate the key rod 90, a 0.094 inch diameter by 1.000 inch long, 316 stainless steel rod with rounded ends. The key rod prevents any rotation of the diaphragm springs or the spacer with respect to the cable spool. During slip, the O-ring must slide with low friction on the outer surface of the spacer, and to facilitate that, the spacer's outer surface can be polished, and then electroless nickel plated 5 microns thick to improve lubricity and hardness. It is a well-known property of Teflon that it tends to take a set over time, a property which will help reduce the compressive force at the spacer, yet increase its ability to maintain concentricity during slip. The last 0.375 inches of the 1.375 inch long cable spool extension, as well as the bore of the threaded ring 91, are threaded along their 4 inch O.D. and I.D., respectively, with a 16 thread per inch, Unified left-hand thread. The left-hand thread will prevent the threaded ring from trying to loosen while the torque-limiter is slipping.

Assembly of the torque-limiter parts onto the cable spool extension is as follows: One of the diaphragm springs (with its friction-lining bonded-in, and protruding 35 mils) is slid on with its non-lining side toward the spool, then rotated so that its axial groove matches the axial groove of the modified cable spool extension. The key rod is then inserted. Next, the gear/O-ring/spacer assembly is lined up with the key rod and slid on. (A 35 mil gap will exist between the first diaphragm spring's inner hub and the spacer.) Following that, the second diaphragm spring (with its friction-lining bonded-in, and protruding 35 mils) is lined up with the key rod and slid on, lining-side toward the spool. (A 35 mil gap will exist between the second diaphragm spring's inner hub & the spacer.) The threaded ring is then threaded-on and tightened using the ⅜ inch diameter spanner wrench holes 911. As it pushes the inner hub of the second diaphragm spring inward, the two 35 mil gaps reduce in size together, accompanied by a like deflection of the diaphragm springs. At the end, when there is no longer any gap at the inner hubs, the diaphragm springs will each be deflected 35 mils. Their outer hubs will remain plane with the web of the gear and exert a compressive force of 1,150 lbs on the web through their friction-linings. At that point, the maximum stress in the aluminum diaphragms is 18,781 psi (well within the 73,000 psi yield strength of the 7075 T6 aluminum used to fabricate the diaphragm springs, and thereby providing a substantial safety factor). Further tightening of the threaded ring produces no further increase in the diaphragm deflection, compressive force, or diaphragm stress. Only the loosening of the thread can reduce the force. Thus after tightening with the spanner wrench, and after an in-process check to verify the nominal 2,000 inch-pound torque-slip value (see paragraph [0120]), a 1/16 inch diameter hole is drilled axially 0.20 inches long anywhere in the thread, and a locking pin pressed-in to absolutely prevent any possible unthreading. A commercial 1/16×3/16 long rolled steel spring-pin may be used as the locking pin.

The friction-lining material specified for this design is Raybestos R-248, an asbestos-free, metal-free, resin bond, with anorganic fillers. Its high temperature resistance and stable 0.28 coefficient of friction over a wide range of contact pressures (from 30 N/cm$^2$ to 120 N/cm$^2$), and long slip times (to 9 minutes), makes it especially well suited for brake/clutch combinations. The recommended surface pressure for R-248 is (15 to 250) N/cm$^2$. The contact pressure in this case is 150 psi (1,150 lbs divided by 7.658 in$^2$) which is equivalent to 103.5 N/cm$^2$ (right in the middle of the range). The R-248 material has a very high compressive elastic modulus of 1.74 Million psi, and as a result, the 150 psi contact pressure causes each 125 mil thick friction-lining to compress only about 0.01 mils, which is completely negligible compared to 35 mils. For R-248, it is recommended that the slip speed be kept below 25 m/sec. The actual slip speed for a 6 foot initial free-fall will start off at 6 m/sec and reduce to zero in less than a second. The slip speed for a nearly impossible 15 foot initial free-fall will start off at 10 m/sec and go to zero in a few seconds. Using the 0.28 coefficient of friction value for the two friction surfaces, along with their areas and locations, the slip torque is computed to be 222.7 Nm or 1,971 inch-lbs. At the initial 3 inch spooled cable radius (6 inch diameter), that torque occurs at a cable force of 657 pounds. However, since 0.28 is the dynamic coefficient of friction, not the higher static coefficient of friction, the true breakaway torque might be closer to 2,100 inch-lbs, with a breakaway cable force of 700 lbs. At that set-point the heaviest persons may cause the torque limiter to come into play for a bit (not a problem) even with no free-fall. That is because the sudden application of a weight upon an unloaded spring (in this case, the cable) can result in a transient force on the spring (the cable) of up to two times that weight.

A numerical example further illustrates the capability of the torque-limiter. Assume a 360 lb man (with a 40 lb pack) has anchored his cable well inside the room. He then stands on the window ledge and jumps. As a result, he free-falls six feet, his free-fall velocity reaching 19.7 ft/sec before his cable (anchored inside the room) gets supported by the ledge. Immediately, the cable spool (with its initial 6 inch spooled diameter) spins up. When it gets to 97 RPM, the cable force is up to 700 lbs and the torque is up to 2100 inch-lbs—which causes the torque-limiter to slip. Right away, dynamic friction replaces static friction, and the torque reduces to 1,971 inch-lbs, the cable force reduces to 657 lbs, and the fan speed reduces from 1941 RPM to 1,880 RPM. All these values remain steady as the unreeling speed of the cable rises to over 19 ft/sec to match the descent speed. That brings the initial cable spool speed up to 700 RPM while the speed of gear #1 stays at about 94 RPM. The resulting friction in the torque-limiter and the energy dissipation of the fan combine to quickly reduce the descent speed from 19.7 ft/sec to 2.46 ft/sec in about 0.833 seconds and about 9 ¼ feet. At that point, the spool speed has been reduced to 94 RPM (matching the rotational speed of gear #1) and the torque-limiter no longer slips. Then fan 6 (by itself) takes the force from 657 lbs down to 400 lbs, and the descent speed from 2.46 ft/sec down to 1.92 ft/sec (the stable descent speed for the total weight of 400 lbs). This extreme example brings into focus the remarkable ability of the built-in torque-limiter to assure the "fail-safeness" of the invention, even when used in what would surely be considered a reckless manner (which may well happen in a panic situation).

Another situation where the torque-limiter can save the day is when one person who is already descending at his slow, safe descent speed is "fallen-on" by another who is free-falling out the window. Clearly, this is an avoidable situation, yet one that could easily occur. Without the torque-limiter, such a situation could overload and break the first person's cable with disastrous results not just for him, but for all the others below. However, with the torque-limiter in-place, as soon as his cable force reaches 700 lbs (or a bit higher if his cable is longer), the torque-limiter will slip, protecting the cable and helping to slow both him and the other person in the process. What's more, it can do this over and over again if need be, just as it can for subsequent free-falls.

Yet, the likelihood of a subsequent free-fall from a lower rooftop is remote. That's because the cable stays taut due to the action of the de-slacker spring 7, and it points nearly straight-up as the person backs over the edge. Hundreds of feet down from the initial descent point, the reduced spooled diameter increases the cable force needed to reach the 2,100 inch-lb set-point that causes the torque-limiter to slip. At 628 feet down, with a spooled diameter of 5 inches, the force increases to 840 lbs (from 700 lbs). And 1,000 feet down, with a 4.2 inch spooled diameter, it's up to 1,000 lbs. More than 1,000 feet down, the spring-constant of the (1,000+ foot) 0.094 inch diameter, 7×19 galvanized steel cable reduces to less than 63 lbs/foot. That's low enough to insure that the cable force will remain below 1,000 lbs for a 360 lb person (and 40 lb backpack) for a free-fall of up to five feet. However, to place such a weak spring in series with the cable up by the carabiner as the solution to the free-fall problem would be impractical, for it would be too long and would have to deflect up to 16 feet in addition . . . and it wouldn't cover any possible length of free-fall. Nor would a "springy" cable-guide in (or on) the backpack, or a torsion spring located between the cable spool and gear #1. None of these come close to matching the capability of the spring-clutch torque limiter.

From the previous paragraph, the importance of maintaining the initial 6 inch spooled diameter so that the initial slip of the torque-limiter will not exceed 700 lbs can be seen. Thus, whenever cable spools are to be wound with shorter cables for expected shorter descents, they should be wound on larger diameter mandrels. The following size mandrels can be used for the following shorter required descent heights (suitable for the upper floors of the indicated buildings), not including any additional slant distances:

- 3.626 inch diameter—1,394 feet (Empire State Building, Bank of China Tower)
- 4.002 inch diameter—1,224 feet (Chicago's Aon Center & John Hancock Center)
- 4.378 inch diameter—1,038 feet (Trump World Tower, One Liberty Place, GE Bldg)
- 4.754 inch diameter—835 feet (Rappongi Tower, Harbourfront Landmark, AXA Ctr)
- 5.130 inch diameter—615 feet (United Nations Plaza Tower, NYC Westin Hotel)
- 5.506 inch diameter—378 feet (typical 25 story apartment buildings)

Winding directly onto the 3.250 inch diameter of cable spool 4*a* yields 1,547 ft (or more), suitable for the Sears Tower, Petronas Towers, and Taipei 101. For the larger diameter mandrels, the present cable spool 4*a* is still used (with the cable-end being locked inside), and the larger diameters are achieved by utilizing two molded, interlocking, lightweight, Delrin®, half-cylinders having a 3.250 inch bore (not shown). Without the molded half-cylinders, the 3.250 diameter cable spool contains 15 rows of the 0.094 diameter wire-rope cable. However, with the Delrin® inserts, the 3.626 inch mandrel contains 13 rows of the wire-rope cable; the 4.002 inch mandrel contains 11 rows; the 4.378 inch mandrel contains 9 rows; the 4.754 inch mandrel contains 7 rows; the 5.130 inch mandrel contains 5 rows; and the 5.506 inch mandrel contains 3 rows. All have 85 turns in each row (within the 8 inch long space), except for the last row in each case which has only 80. That's because the de-slacker spring 7 can rewind rows 80 through 55, "exactly as they were unwound," without the use of a re-guiding mechanism. Although there is ample space within the 7 inch diameter walls for the cable to be rewound on top of itself (with only a minor reduction in the initial cable force at which the torque-limiter trips), such rewinding on top of itself (though not detrimental) is avoided for the initial rewinding. However, for re-windings at smaller diameters (where it may not be avoidable), some rewinding of the cable on top of itself may be indeed beneficial, as it would slightly reduce the otherwise increased trip force.

Because the spring-clutch torque-limiter enables the person to free-fall long-distances multiple times (and be fallen-upon multiple times), another additional type of clutch is made possible—a repeatable automatically-activated thermal-clutch for decoupling fan 6 whenever the surrounding air temperature gets much too high. It would automatically bump the descent speed up to near free-fall conditions through the intense heat of one or more fire floors for any persons who must exit on a non-windward side of the building. Even without heat-resistive protective clothing or a deployable heat shield, the person would survive the experience without any burns, much as a circus tiger survives jumping through a flaming hoop. Immediately upon passing the fire floor, the thermal clutch would re-couple the fan which in turn would cause the spring-clutch torque-limiter to slip to thereby protect the cable from high overload forces while it helps decelerate the person down to the speed where the recoupled fan can take over by itself (as previously described in paragraph [0121]). Both the thermal clutch and the spring-clutch torque-limiter can work over and over in this manner, if necessary to protect the person from multiple fire floors. Many thermal clutch designs are feasible, but one that's simple enough to be described in words (without drawings) is to make the tube-like 3.9 inch long center hub of the fan more like a concentric "tube-within-a-tube," where the 3 inch long center section of the outer tube is now 1/64 inch thick aluminum. (It must be thicker at the ends to support the 8-spoked support plates 49.) The narrow (1/32 inch) annular space between the outer tube and the now larger 2.1 inch diameter inner tube (previously with a 1.5 inch O.D.) is filled with IGI's microcrystalline wax Microsere 5999, which melts at exactly 194° F. (192° F. minimum). Other compounds may be used, but Microsere 5999 provides a well-defined melting point near high-end sauna temperatures, with good hardness and surface adhesion. The ends of the annular space can be sealed with teflon O-rings (or teflon or nylon inserts) to keep the outer tube centered and the wax contained when the wax liquifies. It is likely only the outer few mils of the wax will actually liquify, since the wax itself will act as a thermal insulator. The extremely thin 1/64 inch aluminum, and the liquification of just the outer few mils of the wax, enable its liquification and resolidification to occur very rapidly. And the very low torque requirement of the high-speed shaft (kept to approximately 100 inch-pounds by the spring-clutch torque-limiter) allows the wax to easily transfer that torque when totally solidified, since it calls for a shear strength of only 5 psi. Although the thermal clutch in conjunction with the spring-clutch torque-limiter will protect an otherwise unprotected person from burns when exiting on a non-windward side of the building, it would still be recommended that all persons exit on the windward side.

Since this invention is to be used to save lives, every unit should be final tested in the most comprehensive way to assure that it will perform in a fail-safe manner when required to fulfill its life-saving function. A final functional test is described herein which would prove not only the overall performance, but the performance of each feature including all of those features discussed in paragraphs [0115] through [0124]. (The one exception is the thermal clutch just described in paragraph [0125], whose proper function could be proven with an in-process test on each unit.) For the final functional test, each production unit would be required to take a 360 lb dummy through a 6 foot free-fall and an additional descent of 18 feet, plus the subsequent rewinding of at least 30 feet of cable by de-slacker spring 7. The complete test described herein, with set-up, break-down, and evaluation takes less than a minute. The dummy is configured as a true-life heavyweight torso and wears a real harness. A special linear bearing arrangement lets it descend the 24 feet on two parallel vertical poles with little friction. At the bottom (18 feet below the floor level) is a heavy compression spring to stop the dummy's descent. Inside the dummy is a steel block, which provides the bulk of its 360 pounds. A 2G strain-gage accelerometer is attached to the dummy and oriented vertically, with its output moving positively for a downward acceleration. It has its own power supply and conditioning circuitry, which includes a high-resolution auto-zeroing feature. Also attached to the dummy but oriented horizontally, is a high natural frequency (>5 kHz) piezoelectric accelerometer with its own charge amplifier. An electromagnet located 6 feet above the floor holds the dummy at the top of the poles. A platform enables a technician to install the backpack unit on the dummy, using its straps and the harness support loop. The cable is extended and its carabiner 9 is attached to a precision 2,000 lb load-cell oriented toward the edge 12 feet away, and bolted 3 feet above the floor. When ready, a button is pushed which in rapid sequence, auto-zeros the strain-gage accelerometer, triggers the start of a digital data acquisition unit (with anti-aliasing filters) to sample the outputs of the load cell and two accelerometers at 1,000 samples per second (with 32 bit resolution), and then cuts the current to the electromagnet to release the dummy. The dummy free-falls six feet in 0.610 seconds before the cable comes to rest on the rounded corner of the floor and begins to turn the cable spool. As the fan spins up, the load-cell output (indicating the cable-force) first peaks and then plateaus, indicating the triggering of the torque-limiter, and the slipping of the friction-linings against the web of gear #1. Paragraph [0121] shows that the slipping should continue for 0.833 seconds while the dummy is slowed from 19.7 ft/sec to 2.46 ft/sec in about 9.25 ft, automatically enabling the fan (all by itself) to bring the speed down to the low stable descent velocity of 1.92 ft/sec. That should take only about 0.050 seconds and covers about 0.11 feet. After that, the dummy descends the final 8.64 feet in about 4.45 seconds at the stable velocity of 1.92 ft/sec. The total descent, including the 6 foot free-fall, takes about 6 seconds. A separate cable is utilized to bring the dummy back up in about 12 seconds at about 2 ft/sec, during which the de-slacker spring 7 rewinds the cable onto the cable spool. Meeting the one-minute time allotment requires that the backpack be put onto the dummy and removed in a total time of 42 seconds, which is very doable.

While one technician is taking care of those chores, a second technician can be handling the computerized data acquisition, analysis, and archiving. The data-entering process actually begins with the scanning-in of the bar-coded serial number affixed to the backpack unit. A computer record will already exist with respect to the cable data: its 1,000 lb proof test prior to winding on the cable spool, its indicated length, and its weight measurement verification (for example, the Sears Tower backpack unit is slightly more than 2 pounds heavier than the Empire State Building backpack unit, and so on). In this final proving test, data sampling begins about one second before the electromagnet releases the dummy, and is stopped about one second after it contacts the spring at the bottom. Thus, the three sampled records are about 8 seconds long. With a sample resolution of 32 bits, the three records should comprise nearly 100 kilobytes of data. A computer program then calculates and saves two additional time domain records: The velocity record, obtained by integrating the 2G strain-gage accelerometer record with respect to time . . . and the displacement record, obtained by integrating that velocity record with respect to time. All three records should read zero prior to the release. The program verifies the correct calibration of the accelerometer using two known pieces of information—the acceleration during the free-fall (first 600 sample points following the release) must be exactly 1G (32.2 ft/sec$^2$), and the final displacement must be exactly 24 feet. The load-cell record should read close-to, but not exactly zero prior to the release (for the de-slacker spring will be pulling on the load-cell with a few pounds). After eliminating any noise spikes, the program locates the first major peak in the load cell record, reads it, and notes the sample point number calling it "sample point A" (at the same time, verifying that no other point exceeds this force value). This is the maximum force in the cable, and it should read 700 pounds, within some predetermined tolerance. Sample point A is also the point at which the torque-limiter begins to slip, and the program looks for and verifies a corresponding sudden increased level of output in the high-frequency accelerometer record. At sample point A, the program also verifies a displacement reading of around 6 feet, and a velocity around 20 ft/sec. The program next finds where the level of the output of the high frequency accelerometer suddenly reduces, and calls that sample point B. Presumably this is where the friction-lining re-grips the web of gear #1. The program then verifies that the velocity at point B reads 2.46 ft/sec within some pre-determined tolerance. The program then averages all the acceleration samples between point A and point B and verifies that it reads −0.64 G's (−20.69 ft/sec$^2$) within some predetermined tolerance. The program then averages all the force samples between point A and point B and verifies that it reads 657 lbs within some predetermined tolerance. The program then performs a Fast Fourier Transform on the high-frequency accelerometer record between points A and B using overlap processing (512 points at a time, of the approximately 800 sample points) and then uses a calculation involving the amplitudes of three adjacent frequency points around 226 Hz to calculate the "exact" tooth-mesh frequency of gear #1 and gear #2 with much better resolution than the FFT's resolution (which is only 1.953125 Hz). It then computes the RPM of gear #1 by multiplying that result by 60 and dividing by 144, and verifies that it equals 94 RPM within some predetermined tolerance. Note that the RPM of fan 6 is 20 times that computed value. The program then designates "point B plus 100 sample points" as point C, and verifies that the acceleration at point C has returned to 0 G's within some predetermined tolerance. The program then finds where the acceleration again peaks up negatively (contact with the compression springs at the bottom), and designates that as point D. The program then averages up all the velocities readings between point C and point D, first dividing it into ten serial groups and then verifying that each group averages 1.92 ft/sec within some predetermined tolerance. The program then similarly averages the load-cell force between point C and point D.

The load-cell force, and other values in paragraph [0126], will vary slightly depending upon the total weight, which of course depends upon the length of cable in the backpack unit. The computer program will know this from the bar-coded record and automatically take that into account. Unless the program flags an out-of-tolerance situation, the technician may assume everything is within acceptable limits. Following a visual check through the grillwork to verify that the cable has been properly rewound on its cable spool by the de-slacker spring 7, the backpack unit is packed and sealed in its storage case (designed to fit unobtrusively in an office cubicle) with the assurance that this one-minute computerized test has proven the following: that even for the heaviest (360 lb) person, the torque-limiter slipped at the proper force level to protect the cable following a lengthy initial free-fall; that the torque-limiter performed properly while slipping; that the subsequent re-gripping of the friction-linings to the web of gear #1 took place at the proper speed and torque; that the fan (all by itself) then quickly and easily brought the cable force down to the total weight while it brought the speed down to the proper descent speed, that the descent speed remained stable; that the de-slacker spring 7 properly rewound 30 feet of cable; and finally that the spring clips 72, attachment ropes 13, and tensioning devices 15 all worked properly.

All of the sampled data, plus all the calculations performed automatically by the program following the test run are archived under the backpack unit's serial number. That amount of data might add up to a megabyte, so each test station might store a very manageable gigabyte per day (testing one-unit per minute per test-station over two eight-hour shifts). It should be appreciated that the performance of each unit does not depend upon the computerized functional test. The test merely verifies that performance very efficiently. And a more low-tech test may accomplish the end purpose of verifying that performance equally as well.

Although the backpack assembly, the headgear assembly, the torque-limiter, the comprehensive functional test, and all the rest have been described or specified in detail in the present application, it is important to realize that alternate arrangements still within the scope of the present invention would have been feasible. It will be appreciated by those skilled in the art that changes or modifications could be made to the above-described embodiments without departing from the broad inventive concepts of the invention. It should be appreciated, therefore, that the present invention is not limited to the particular embodiments disclosed but is intended to cover all embodiments within the scope or spirit of the described invention.

What I claim is:

1. An evacuation apparatus for enabling a person within a prescribed weight range to descend from an origin at a predetermined height in a multistory building to a lower supporting surface and to attain a descent speed of less than four feet per second to land injury-free, the apparatus comprising:

a harness securable to the person;

a housing affixed to the harness;

a cable within the housing, of predetermined length sufficient to reach from the origin to the lower supporting surface, the cable having a free end which includes a securing member for attaching the free end to a fixed anchorage proximate the origin; and a descent-slowing energy-dissipating mechanism within the housing, driven by the playout of the cable from the housing as the person descends, which enables the person to attain automatically within his descent a descent speed of less than four feet per second without the person's control, the descent speed being determined by the intersection of the graph of the curve that describes, for the amount of remaining cable, the rate of energy dissipated as a function of the descent speed and the graph of the line that describes the rate of potential energy released by the total amount of descending weight as a function of the descent speed, and where the slope of the graph of the rate of energy dissipated curve exceeds the slope of the graph of the rate of potential energy released line in the vicinity of the intersection.

2. The apparatus as recited in claim 1 wherein the apparatus includes a rotatable member within the housing and the playout of the cable from the housing causes the rotatable member to rotate.

3. The apparatus as recited in claim 2 wherein the apparatus further comprises a cable force limiting mechanism to protect the cable from transient overloads.

4. The apparatus as recited in claim 3 wherein the cable force limiting mechanism is a torque limiting mechanism applied to the rotatable member.

5. The apparatus as recited in claim 4 further comprising a thermal clutch that automatically decouples the energy dissipating mechanism when the ambient temperature goes above a preset temperature.

6. The apparatus as recited in claim 5 wherein the thermal clutch recouples the energy dissipating mechanism when the ambient temperature goes below the preset temperature.

7. The apparatus as recited in claim 2 wherein the rotatable member is a spool that houses the cable.

8. The apparatus as recited in claim 7 further comprising a cable de-slacking mechanism within the housing.

9. The apparatus as recited in claim 8 wherein the cable de-slacking mechanism removes slack from the cable prior to the descent.

10. The apparatus as recited in claim 8 wherein the cable de-slacking mechanism removes slack from the cable prior to subsequent descents from other supporting surfaces located below the predetermined height.

11. The apparatus as recited in claim 8 wherein the cable de-slacking mechanism comprises a substantially constant-torque spring that rewinds the spool that houses the cable.

12. The apparatus as recited in claim 2 wherein the energy dissipating mechanism is driven by the rotation of the rotatable member through a speed-increaser.

13. The apparatus as recited in claim 12 wherein the speed-increaser is comprised of an arrangement of gears.

14. The apparatus as recited in claim 12 wherein the speed-increaser is comprised of a belt and pulley arrangement.

15. The apparatus as recited in claim 1 wherein the energy dissipating mechanism comprises an air resistance fan with a plurality of vanes.

16. The apparatus as recited in claim 15 wherein the vanes of the fan are substantially semi-cylindrical in shape.

17. The apparatus as recited in claim 1 wherein the energy dissipating mechanism comprises a generator and resistance.

18. The apparatus as recited in claim 7 wherein the resistance comprises a plurality of resistors which are switch-selectable prior to the descent.

19. The apparatus as recited in claim 1 wherein the energy dissipating mechanism comprises an eddy current brake, which includes a stator and a rotor with a gap therebetween, wherein the size of the gap between the stator and the rotor is adjustable prior to the descent.

20. The apparatus as recited in claim 1 wherein the apparatus further comprises a cable force limiting mechanism to protect the cable from transient overloads.

21. The apparatus as recited in claim 20 wherein the cable force limiting mechanism is at least one energy-absorbing web in-line with the cable.

22. The apparatus as recited in claim 20 wherein the cable force limiting mechanism is the reduced spring-constant of the played-out cable.

23. The apparatus as recited in claim 1 wherein the harness includes at least one of:

straps, ropes, tethers, clips, buckles, snaps, ties, rings, hook and loop fasteners, tensioners, bungees, bands, loops, and belts, that accommodate to the size of the person.

24. The apparatus as recited in claim 1 wherein the cable is capable of supporting at least two and a half times the maximum descending weight.

25. The apparatus as recited in claim 1 wherein the cable is a steel wire-rope.

26. The apparatus as recited in claim 1 wherein the cable is a high-strength polymer cable.

27. The apparatus as recited in claim 1 wherein the cable is made up of a composite of materials.

28. The apparatus as recited in claim 1 wherein the securing member is a carabiner.

29. The apparatus as recited in claim 1 wherein the fixed anchorage can accommodate a plurality of securing members.

30. The apparatus as recited in claim 1 wherein the fixed anchorage is adapted to be located proximate an egress opening of the building.

31. The apparatus as recited in claim 1 wherein the fixed anchorage is adapted to be secured to a structural member of the building.

32. The apparatus as recited in claim 1 further including a protective helmet worn by the person.

33. The apparatus as recited in claim 1 further including an air filtration system which may or may not be within or attached to the housing.

34. The apparatus as recited in claim 33 wherein the air filtration system filters out smoke and other combustion products for at least 30 minutes.

35. The apparatus as recited in claim 1, wherein the person is a child and further including a protective enclosure for receiving the child, and wherein the harness is at least one of a belt and a latching mechanism that secures the housing to the enclosure.

36. A method for enabling a person within a described weight range to descend automatically from an origin at a predetermined height in a multistory building to a lower supporting surface and to attain a descent seed of less than four feet per second to land injury-free, using an evacuation apparatus comprising a housing that contains a (1) cable that is long enough to reach from the origin to the lower supporting surface and (2) a descent-slowing energy dissipating mechanism, the cable having a free end with a securing member for attaching to a fixed anchorage proximate the origin, and a harness affixed to the housing, the method comprising the steps of:

using the harness to securely affix the housing to the person;

attaching the free end of the cable to the fixed anchorage;

exiting the building at the origin of the descent; and descending to the lower supporting surface while the descent-slowing energy dissipating mechanism enables the person to attain automatically within his descent a descent speed of less than four feet per second.

37. An evacuation apparatus for enabling a person within a prescribed weight range to descend from an origin at a predetermined height in a multistory building to a lower supporting surface and to attain a descent speed of less than four feet per second to land injury-free, the apparatus comprising:

a housing containing a cable;

a harness affixed to the housing for securely affixing the housing to the person;

a cable of predetermined length sufficient to reach from the origin to the lower supporting surface, the cable having a free end which includes a member for securing the free end to a fixed anchorage proximate the origin; and a speed-slowing energy-dissipating means within the housing and driven by the playout of the cable from the housing as the person descends, the energy-dissipating means enabling the person to attain automatically within his descent a descent speed of less than four feet per second without the person's control, the descent speed being determined by the intersection of the graph of the curve that describe, for the amount of remaining cable, the rate of energy dissipated as a function of the descent speed and the graph of the line that describes the rate of potential energy released by the total amount of descending weight as a function of the descent speed, and where the slope of the graph of the rate of energy dissipated curve exceeds the slone of the graph of the rate of potential energy released line in the vicinity of the intersection.

38. A mass evacuation system for rescuing a plurality of persons from origins at predetermined heights in a multistory building to at least one lower supporting surface, the system including a plurality of evacuation apparatuses, each apparatus enabling a person within a prescribed weight range to descend at a sufficiently slow descent speed to land without injury to himself or other persons using the system, with at least one person using the system attaining a speed of less than four feet per second, each vacuation apparatus comprising:

a harness securable to a person;

a housing affixed to the harness;

a cable within the housing, of predetermined length sufficient to reach from the origin to the lower supporting surface, the cable having a free end which includes a securing member for attaching the free end to a fixed anchorage proximate the origin; and a descent-slowing energy-dissipating mechanism within the housing, driven by the playout of the cable from the housing as the person descends, which enables the person to attain automatically a descent speed of less than four feet per second without the person's control the descent speed being determined by the intersection of the graph of the curve that describe, for the amount of remaining cable, the rate of energy dissipated as a function of descent speed and the graph of the line that describes the rate of potential energy released by the total amount of descending weight as a function of the descent speed, and where the slope of the graph of the rate of energy dissipated curve exceeds the slope of the graph of the rate of potential energy released line in the vicinity of the intersection.

39. An evacuation apparatus for enabling a person to descend from an origin at a predetermined height in a multistory building to a lower supporting surface, the apparatus including a housing, a cable within the housing having a free end for attachment to a fixed anchorage proximate to the origin, a descent-slowing energy dissipating mechanism within the housing driven by the playout of the cable as the person descends, and a harness affixed to the housing and securable to the person such that the energy dissipating mechanism enables the person to attain automatically within his descent, a descent speed of less than four feet per second, in combination with a cable-retracting mechanism within the housing to eliminate any slack in the cable, thereby reducing free-falls during initial and possible subsequent descents.

40. An evacuation apparatus for enabling a person to descend from an origin at a predetermined height in a multistory building to a lower supporting surface, the apparatus including a housing, a cable within the housing having a free end for attachment to a fixed anchorage proximate to the origin, a descent-slowing energy dissipating mechanism within the housing driven by the plavout of the cable as the person descends, and a harness affixed to the housing and securable to the person, in combination with a mechanism to protect the cable during the descent from transient overloads beyond its capability, the mechanism comprising at least one of: an in-line energy-absorbing web in-line with the cable at the origin, a torque-limiting mechanism within the housing, and a reduced effective spring constant resulting from the increased length of the played-out cable such that the energy dissipating mechanism enables the person to attain automatically within his descent, a descent speed of less than four feet per second.

41. An evacuation apparatus for enabling a person to descend from an origin at a predetermined height in a multistory building to a lower supporting surface, including a housing, a cable within the housing having a free end for attachment to a fixed anchorage proximate to the origin, a descent-slowing energy dissipating mechanism within the housing driven by the plavout of the cable as the person descends, and a harness affixed to the housing and securable to the person, which enables the person to attain automatically within his descent, a descent speed of less than four feet per second, in combination with an air filtration system which may or may not be within or attached to the housing, the air filtration system being capable of filtering out smoke and other combustion products to enable the person to breathe safe air at least during the period before exiting the building.

42. An evacuation apparatus for enabling a person to descend from an origin at a predetermined height in a multistory building to a lower supporting surface, including a housing, a cable within the housing having a free end for attachment to a fixed anchorage proximate to the origin, a descent-slowing energy dissipating mechanism within the housing driven by the plavout of the cable as the person descends, and a harness affixed to the housing and securable to the person, which enables the person to attain automatically within his descent, a descent speed of less than four feet per second in combination with a device to protect against heat exposure injury, the device comprising at least one of: a deployable heat-deflecting shield, a heat-deflecting body suit, and a thermal mechanism within the housing to increase the descent rate of the apparatus through hot zones.

43. An evacuation apparatus for enabling a person to descend from an origin at a predetermined height in a multistory building to a lower supporting surface, including a housing, a cable within the housing having a free end for attachment to a fixed anchorage proximate the origin, a descent-slowing energy dissipating mechanism within the housing driven by the playout of the cable as the person descends, and a harness affixed to the housing and securable to the person, which enables the person to attain automatically within his descent, a descent speed of less than four feet per second, in combination with a full-head protection helmet protecting the person against falling debris and incidental contact with obstacles dunng the descent.

* * * * *